US006435119B1

(12) United States Patent
Pelletier et al.

(10) Patent No.: US 6,435,119 B1
(45) Date of Patent: Aug. 20, 2002

(54) WATERCRAFT VENTILATION SYSTEM

(75) Inventors: Martin Pelletier, Granby; Jacques Beaudoin, Quebec; François Giroux, Valcourt, all of (CA)

(73) Assignee: Bombardier Inc., Valcourt (CA)

( * ) Notice: Subject to any disclaimer, the term of this patent is extended or adjusted under 35 U.S.C. 154(b) by 0 days.

(21) Appl. No.: 09/938,830

(22) Filed: Aug. 27, 2001

Related U.S. Application Data

(60) Provisional application No. 60/229,330, filed on Sep. 1, 2000, and provisional application No. 60/227,582, filed on Aug. 25, 2000.

(51) Int. Cl.[7] ..... B63B 35/73

(52) U.S. Cl. ..... 114/55.51; 114/55.57; 114/363

(58) Field of Search ..... 440/38, 77, 88; 114/363, 55.5, 55.51, 55.53, 55.57

(56) References Cited

U.S. PATENT DOCUMENTS

| | | | | | |
|---|---|---|---|---|---|
| 5,752,867 | A | * | 5/1998 | Koyanagi | 114/363 |
| 5,918,564 | A | * | 7/1999 | Ohtsuka et al. | 114/363 |
| 5,957,072 | A | | 9/1999 | Hattori | |
| 2001/0050038 | A1 | * | 12/2001 | Gohara | 114/55.5 |

OTHER PUBLICATIONS

Bombardier "Sea–Doo," Parts Catalog 2000, RX 5513/5514, p. D3, D7 & D8, Dec. 1999.

Bombardier "Sea–Doo," Parts Catalog 1996, GTX 5640, p. A1, A2, C11, D2 & D3, Mar. 1996.

Yamaha, WaveRunnner XL 1200 Ltd., Service Manual, p. 8–24, 8–25, 8–31 and 8–32, Apr. 1999.

Printout, dated Dec. 19, 2001, from www.jetski.com, providing a brief technical summary of the Polaris Genesis Watercraft from the 2000 model year.

Printout, dated Dec. 19, 2001, from www.polarisindustries.com, providing a technical summary of the 2001 Model year Polaris Genesis Watercraft.

* cited by examiner

*Primary Examiner*—Stephen Avila

(74) *Attorney, Agent, or Firm*—Pillsbury Winthrop LLP

(57) ABSTRACT

A watercraft is provided that includes a rearwardly facing ventilation opening, which allows ambient air to flow into a hull assembly of the watercraft. A seat is provided that has a seating surface configured to accommodate at least one rider seated thereon. The seat is mounted on the hull assembly such that the seat covers the ventilation opening of the hull assembly to obstruct water from flowing therein and forms one or more air pathways between the seat and hull assembly. Each of the one or more air pathways has one end open to the atmosphere and an opposite end open to the ventilation opening to enable air to flow between the atmosphere and the ventilation opening between the seat and the hull assembly via the one or more air pathways.

27 Claims, 22 Drawing Sheets

WATERCRAFT VENTILATION SYSTEM

This application claims priority to U.S. Provisional Application Ser. No. 60/229,330, filed Sep. 1, 2000 and U.S. Provisional Application Ser. No. 60/227,582, filed Aug. 25, 2000, both of which are hereby incorporated herein by reference.

FIELD OF THE INVENTION

This invention relates to personal watercraft, and more particularly, to a ventilation system for a personal watercraft.

BACKGROUND OF THE INVENTION

Seats for personal watercraft generally have elongated configurations for supporting at least one rider in straddle-type fashion. It is typically considered preferable to position the seat along a centerline of the watercraft and arrange the seat such that a rider is positioned proximate the center (relative to both a longitudinal direction and a lateral direction) of the watercraft. This configuration ensures stability of the watercraft (relative to pitch and roll, respectively, of the watercraft) and maintains a weight distribution that enhances performance. As the watercraft skims along the surface of a body of water, only a small rearward portion of the hull remains in contact with the body of water during high-speed travel. A proper weight distribution allows a sufficient surface area of the hull to maintain contact with the water, while minimizing drag due to excessive hull contact with the water. Some personal watercraft may accommodate more than one rider, in which case the respective seat is lengthened or an additional seat is added, such that more than one rider may be positioned on the watercraft, one behind the other.

Personal watercraft typically utilize internal combustion engines for power generation. To maximize space savings, personal watercraft typically have access to an engine compartment or a storage bin under the seat. It is therefore necessary, for this type of design, for the seat to be removable. The seat in this case must allow for easy removal from and secure fastening to the watercraft. Generally, a U-bolt, or the like, is attached to the hull assembly to cooperate with a mating component on one end of the seat. However, the U-bolt increases componentry of the watercraft.

As described above, the engine of a personal watercraft is disposed within the hull assembly, which makes it necessary to provide an air intake through the hull assembly, through which air may flow to the engine. Air intakes for personal watercraft must deter water from entering, while allowing a sufficient volume of air to flow to the engine for proper engine performance.

Consequently, there is a need in the art for a more component-efficient seat for a personal watercraft. Further, there also exists a need for a more effective ventilation system.

SUMMARY OF THE INVENTION

It is an object of the present invention to meet the need for a more efficient and effective ventilation system. To achieve this object, the present invention provides a watercraft for traveling along the surface of a body of water that includes a hull assembly and an internal combustion engine. The hull assembly includes a bottom portion, or hull, and an upper portion, or deck. The hull assembly has ventilation opening that allows ambient air to flow into the interior of the hull assembly. Additionally, the hull assembly has an exterior surface with one or more portions defining one or more partial air pathways.

The internal combustion engine is mounted within the hull assembly and generates power by combusting a mixture of fuel and air. A propulsion system is operatively connected to the engine and propels the watercraft along the surface of the body of water.

A seat is provided that has a seating surface configured to accommodate at least one rider seated thereon. An interior surface of the seat is configured to engage with the exterior surface of the hull assembly. The interior surface includes one or more portions defining one or more partial air pathways. In the context of this application, this does not only encompass conduits but also encompasses gaps that define air pathways between the seat and exterior surface of the hull assembly.

The seat is mounted on the hull assembly such that the seat covers the ventilation opening of the hull assembly to obstruct water from flowing therein. Furthermore, the seat is mounted on the hull assembly such that the one of more partial air pathways of the seat interior surface and the hull assembly exterior surface are positioned adjacent one another in cooperating relation to form one or more air pathways between the seat and hull assembly. Each of the one or more air pathways have one end open to the atmosphere and an opposite end open to the ventilation opening to enable air to flow between the atmosphere and the ventilation opening between the seat and the hull assembly via the one or more air intake openings.

It is another object of the present invention to meet the need for a more component-efficient seat for a personal watercraft. To meet this object, the present invention provides a personal watercraft for traveling along the surface of a body of water that comprises a hull assembly having a ventilation opening that allows ambient air to flow into the interior of the hull assembly and that has a first interlocking member.

The personal watercraft also includes an internal combustion engine mounted within the hull assembly. The engine is constructed and arranged to generate power by combusting a mixture of fuel and air. A propulsion system is operatively connected to the engine. The propulsion system is constructed and arranged to propel the watercraft along the surface of the body of water using the power generated by the engine.

The personal watercraft further includes a seat having an outer seating surface configured to accommodate at least one rider seated thereon. The seat has a retaining member and a second interlocking member spaced from the retaining member. The seat is mounted on the hull assembly with the seat being retained on the hull assembly by the retaining member being received in the ventilation opening and the first and second interlocking members being engaged in a cooperating interlocked relationship. The at least one of interlocking member is movable to a released position to permit removal of the seat.

Other objects, features and advantages of the present invention will become apparent from the following detailed description, the accompanying drawings and the appended claims.

DETAILED DESCRIPTION OF THE INVENTION

Figure 1:
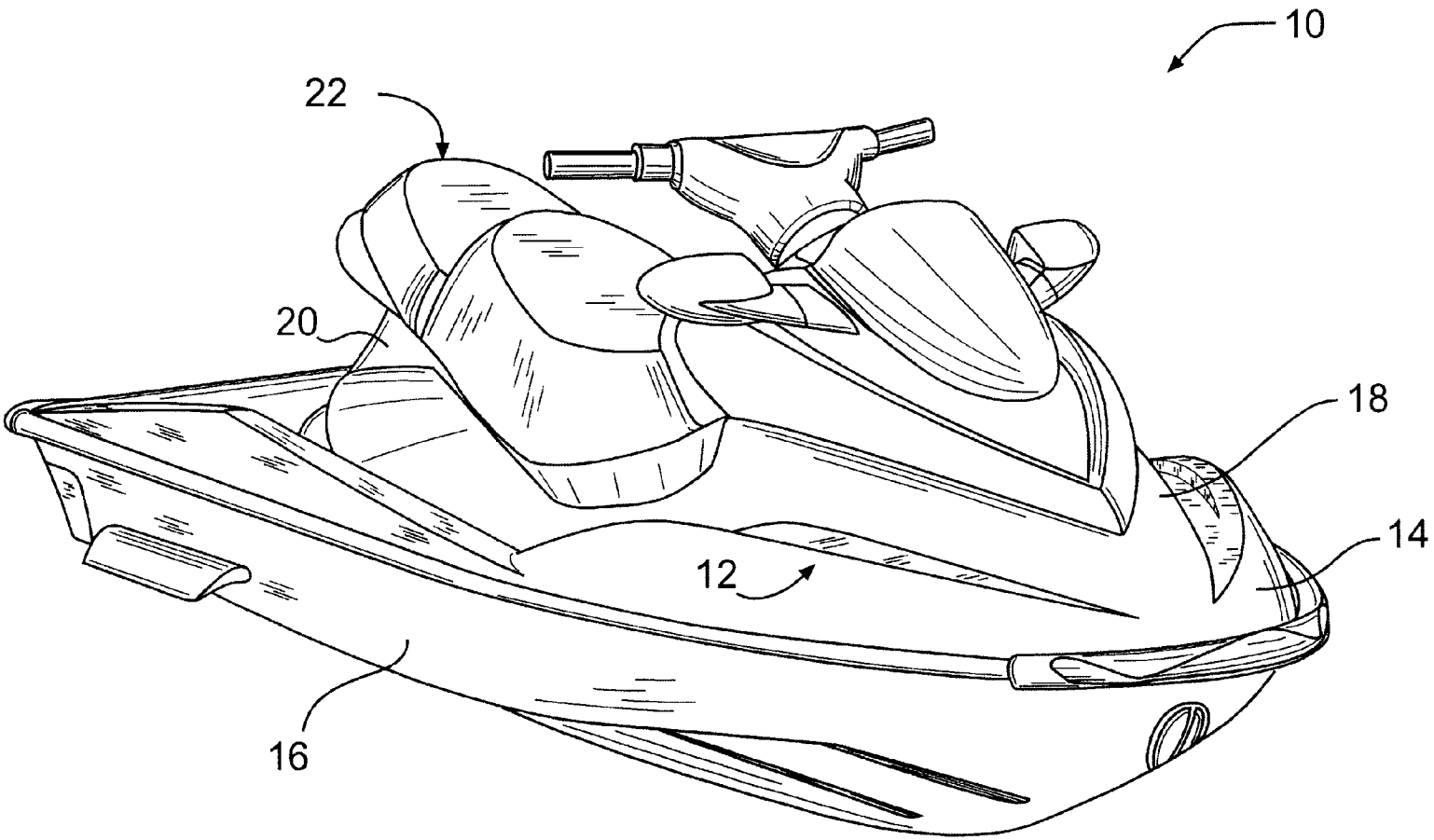
FIG. 1 is a perspective view of a personal watercraft embodying the principles of the present invention.

FIG. 1 shows a personal watercraft 10 embodying the principles of the present invention. The personal watercraft 10 includes a hull assembly 12 formed preferably from a fiber-based composite, such as fiberglass, and having an exterior surface 14. The hull assembly 12 includes a hull 16 and a deck 18 fixedly attached and sealed to the hull 16. Deck 18 includes a pedestal portion 20 extending upwardly therefrom. The personal watercraft 10 further includes a straddle-type seat 22 that is arranged to accommodate at least one rider seated thereon. As shown, the seat 22 is mounted on an upper portion of the pedestal portion 20.

Figure 2:
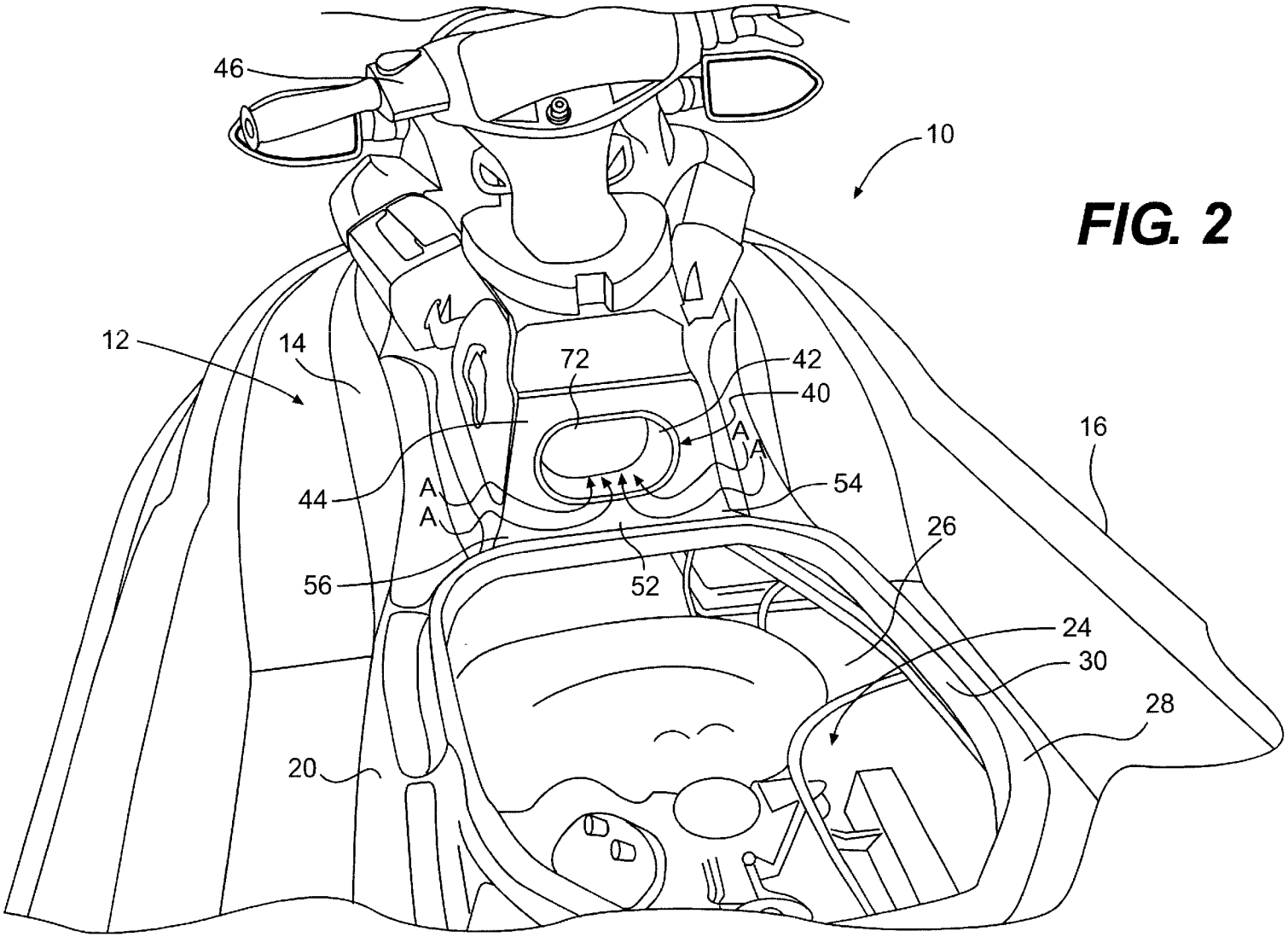
FIG. 2 is a rear perspective view of the personal watercraft shown in FIG. 1 with the seat removed.
Figure 3:
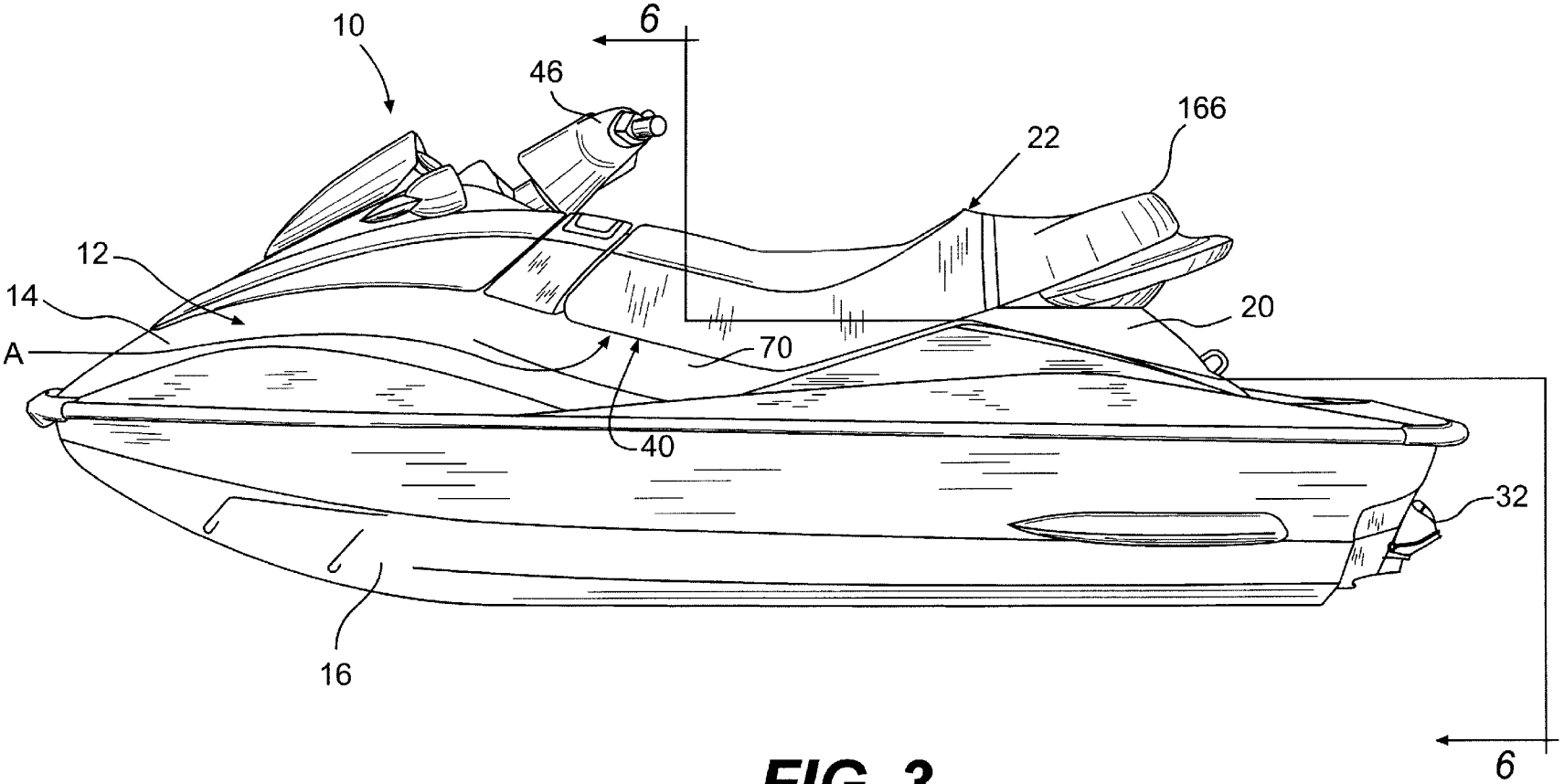
FIG. 3 is a side view of the personal watercraft shown in FIG. 1.

FIG. 2 shows the personal watercraft 10 with an internal combustion engine 24. Internal combustion engine 24 is disposed within an engine compartment 26 of hull assembly 12 formed by the pedestal portion 20 and hull 16. An upper peripheral edge portion 28 of the pedestal portion 20 defines a vertically extending engine-accessing opening 30 that is closed and substantially sealed by an engagement of seat 22 on the peripheral edge portion 28. The engine 24 generates power by the combustion of a fuel/air mixture inside a series of combustion chambers. Internal combustion engine 24 is operatively connected to propulsion system 32 (shown in FIG. 3), which in turn propels the personal watercraft 10 along a surface of a body of water. The propulsion system 32 in the illustrated embodiments is in the form of an impeller, but may alternatively be an external propeller.

Due to the engine 24 being enclosed within the hull assembly 12 and the need to ventilate the interior of the hull assembly 12, the watercraft 10 is provided with a ventilation system, as described below. It is noted that the ventilation system preferably includes at least two separate ventilation paths between the interior of the hull assembly 12 and the atmosphere to accommodate both proper air circulation and sufficient air flow to the engine 24.

FIG. 2 further shows an exemplary embodiment of a forward ventilation subsystem 40 for the personal watercraft 10. The forward ventilation subsystem 40 includes a ventilation opening 42 extending generally longitudinally (relative to the watercraft 10) through a generally vertically oriented wall 44 of the pedestal portion 20. The wall 44 is positioned beneath a handle bar portion 46 of a steering assembly. It is noted that the wall 44 may be disposed forwardly or rearwardly of the handle bar portion 46. Ventilation opening 42 allows ambient air to enter and/or exit the hull assembly 12, including the engine compartment 26. In the illustrated embodiment, ventilation opening 42 is disposed along the centerline of hull assembly 12 and extends in a longitudinal direction relative to the hull assembly 12. As will be described in further detail below, the personal watercraft 10 has a pair of elongated ventilation passages 48, 50 (shown in FIG. 6) that allow air flow between the atmosphere and the ventilation opening 42. Respective ends of each ventilation passage 48, 50 is communicated to the atmosphere and to the ventilation opening 42 to allow air to flow between the atmosphere and the interior of the hull assembly 12 (including the engine compartment 26) through the ventilation opening 42.

Referring to FIG. 2, the exterior surface 14 of the hull assembly 12 has one or more portions defining one or more partial air pathways 52. The one or more partial air pathways 52 preferably include starboard side and port side partial air pathways 54, 56, respectively. As shown, each of the starboard side and port side partial air pathways 54, 56 is provided by a corresponding recess formed within the hull assembly 12.

Figure 4:
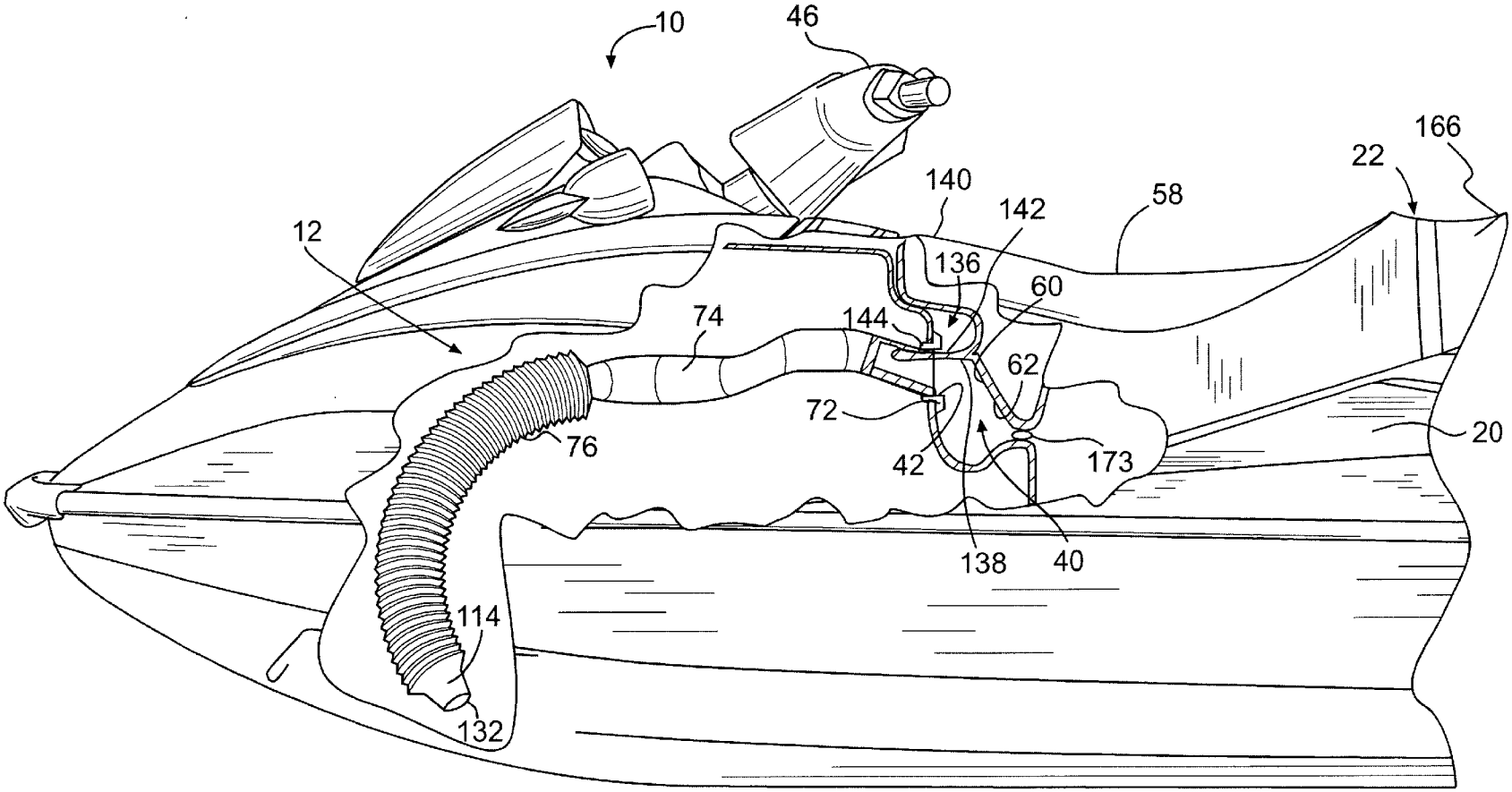
FIG. 4 is a side view of the personal watercraft with a cutout to detail hidden features.
Figure 5:
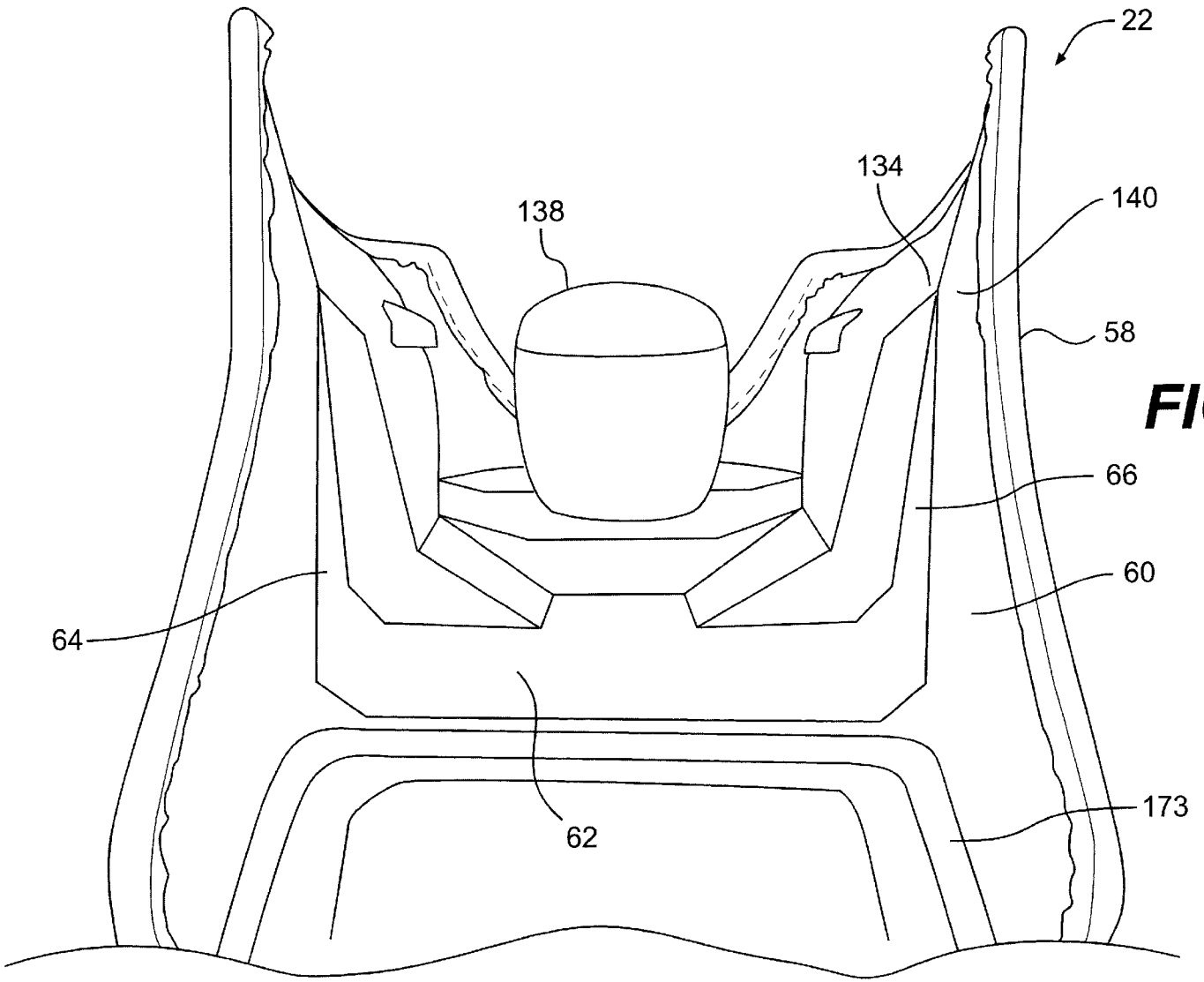
FIG. 5 is a bottom view of the forward portion of the seat.

Shown in FIG. 4, seat 22 has an exterior surface 58 for receiving one or more riders in seated relation thereon and an interior surface 60 with one or more elongated partial air pathways 62 defined thereon. Seat 22 is mounted on the pedestal portion 20 and arranged to cover the ventilation opening 42 to obstruct the direct intake of water through ventilation opening 42. As shown in FIG. 5, partial air pathway 62 includes starboard side and port side partial air pathways 64, 66, respectively. As shown, each of the starboard side and port side partial air pathways 64, 66 is formed by a recess within the interior surface 60 of the seat 22 at a forward portion thereof. Starboard side and port side partial air pathways 64, 66 cooperate with associated starboard side and port side partial air pathways 54, 56, respectively, to form the starboard side and port side ventilation passages 48, 50, shown in FIG. 6.

Figure 6:
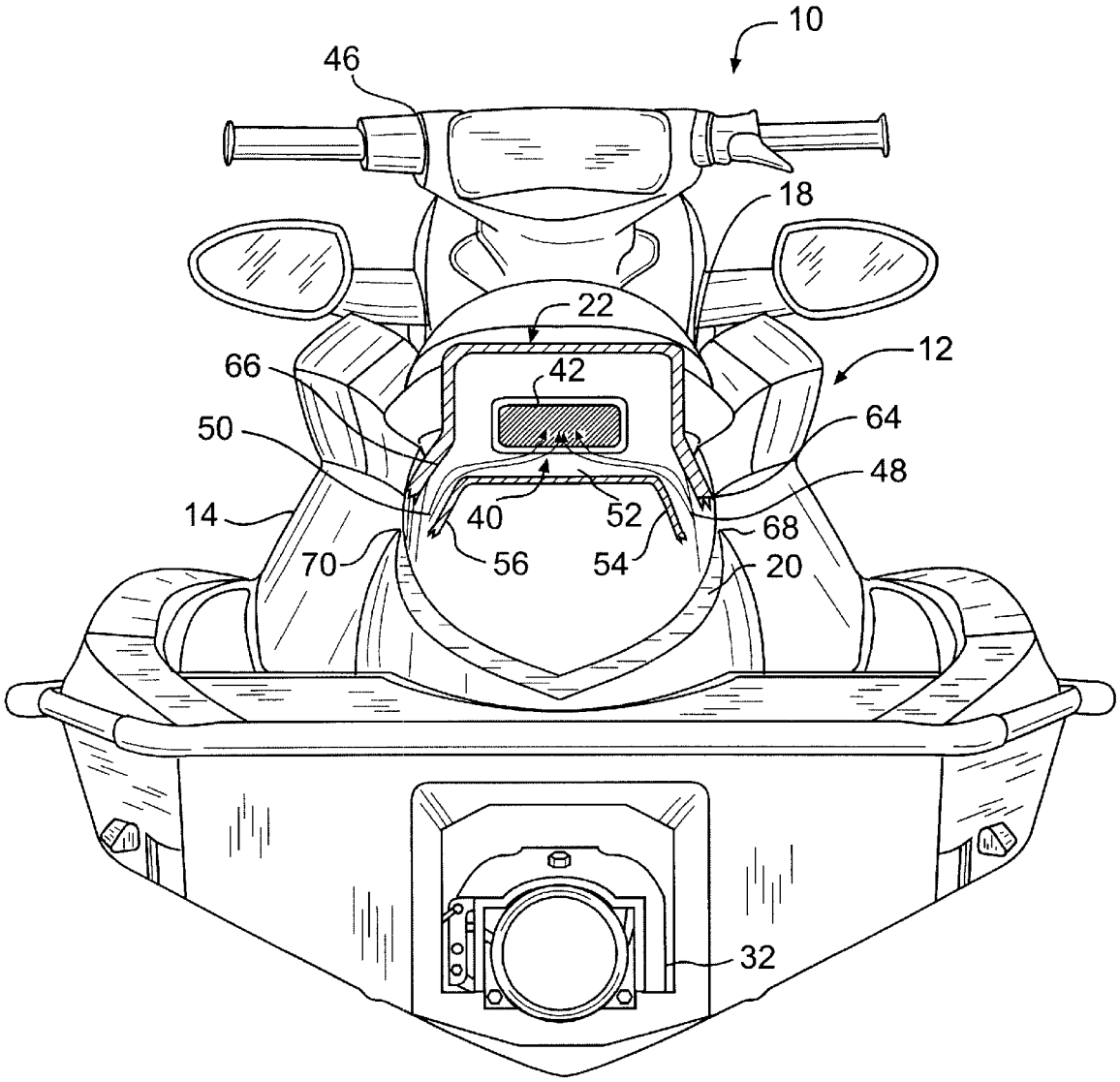
FIG. 6 is a sectional taken along the line 6—6 in FIG. 3.

As shown in FIG. 6, starboard and port side ventilation passages 48, 50 each have one end open to ventilation opening 42 and extend generally laterally from ventilation opening 42. The passages 48, 50 each open to the atmosphere to define respective starboard and port side ventilation openings 68, 70. As the personal watercraft 10 travels in a forward direction, air flows generally rearwardly along the exterior surface 14 of the hull assembly 12 (as shown generally with arrow A in FIG. 3) and may enter the starboard and port side ventilation openings 68, 70. As air enters the starboard and port side ventilation passages 48, 50 via the ventilation openings 68, 70 (as generally shown in FIG. 6) the air changes direction approximately 90° from a rearward flowing direction to a laterally flowing direction. The air then changes directions again, approximately 90° to enter the ventilation opening 42 (shown generally by arrows A in FIG. 2). The inertia of water particles suspended in the air flowing through the ventilation passages 48, 50 acts to separate the water particles from the air flow due to the 180° change in flow direction. The turbulence of the converging air streams (from opposing ventilation passages 48, 50) may also serve to facilitate separating water particles from the air flow prior to entering the ventilation opening 42.

It may be preferable for ventilation opening 42 to include a seal element 72, shown in FIGS. 2 and 4. It is contemplated that a grommet member or an elastomeric seal may provide the seal element 72. Seal element 72 serves to protect the inner edge of ventilation opening 42 from damage, such as fraying and splintering, especially when the hull assembly 12 is formed of fiber-based composite. Furthermore, seal element 72 allows one end of a tubular conduit 74 to be engaged therewith. The tubular conduit 74 extends generally forwardly from seal element 72. An opposite end of the tubular conduit 74 has a branched portion with starboard and port side generally downwardly extending ducts 76 connected to associated branches. It is contemplated that, in lieu of the branched portion, a single duct may be used. Once air from the atmosphere reaches and enters the ventilation opening 42, the air enters tubular conduit 74 and travels generally forwardly therein. The air is then directed generally downwardly through the ducts 76. The ducts 76 direct the air generally downwardly, such that remaining water particles present within the air are directed toward the bottom of the hull assembly 12. A portion of the air exiting the ducts 76 may be taken in by internal combustion engine 24 to be mixed with fuel and combusted for power generation. An air box or other air/water separating device (not shown) may be connected to an engine air intake (not shown) to separate any excess water from the air prior to combustion.

Figure 7:
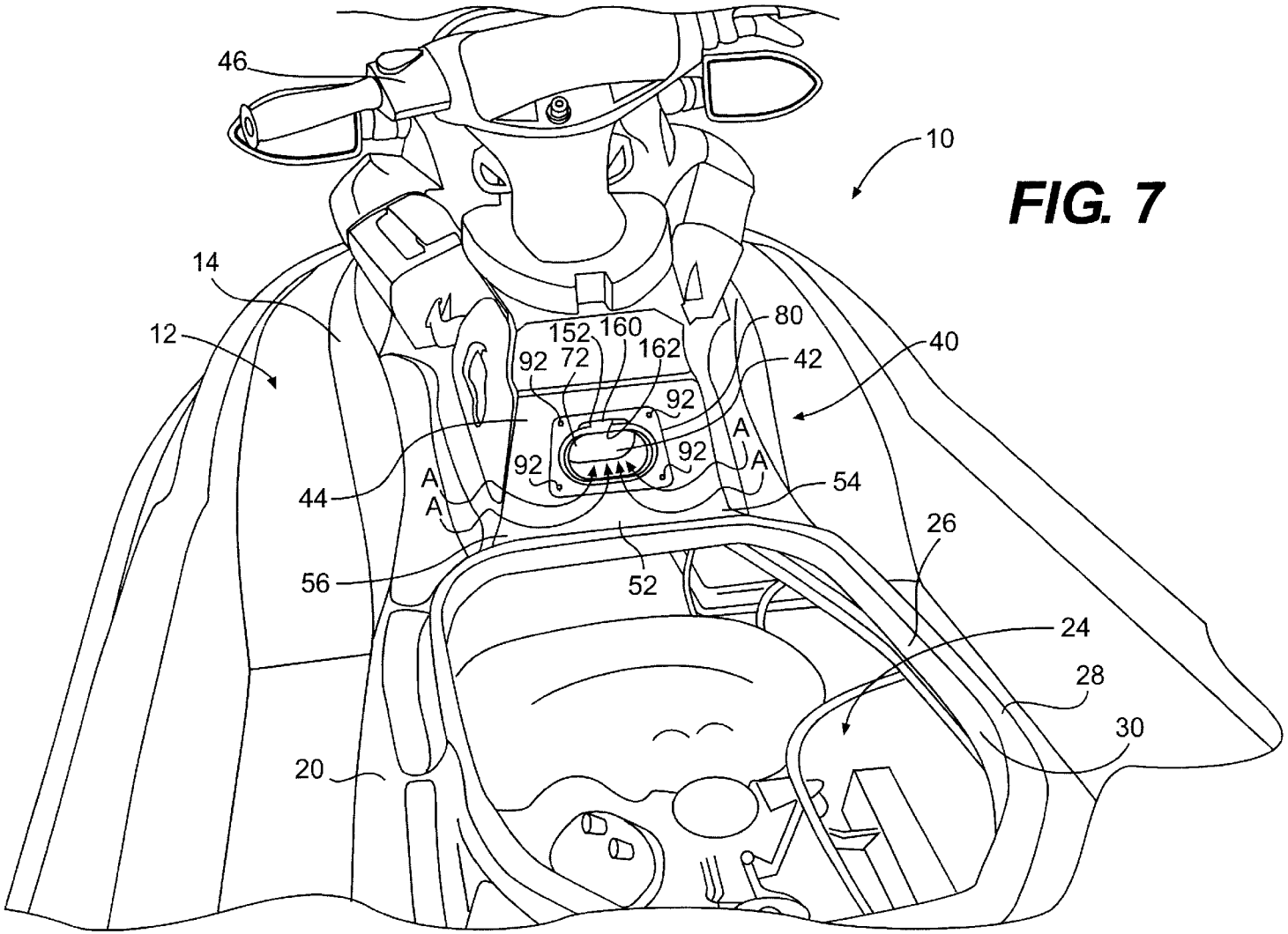
FIG. 7 is a rear perspective view of the personal watercraft shown with an alternate embodiment forward ventilation subsystem.

FIG. 7 shows another exemplary embodiment of the forward ventilation subsystem 40. As shown, a flanged connecting member 80 is connected to the hull assembly 12 in communication with the ventilation opening 42 such that air may enter/exit the interior of the hull assembly 12 (including the engine compartment 26). It is contemplated that the flanged connecting member 80 may be formed by molding a polymer material. It is also contemplated that the flanged connecting member 80 may be formed from a shaped metallic material.

Figure 8:
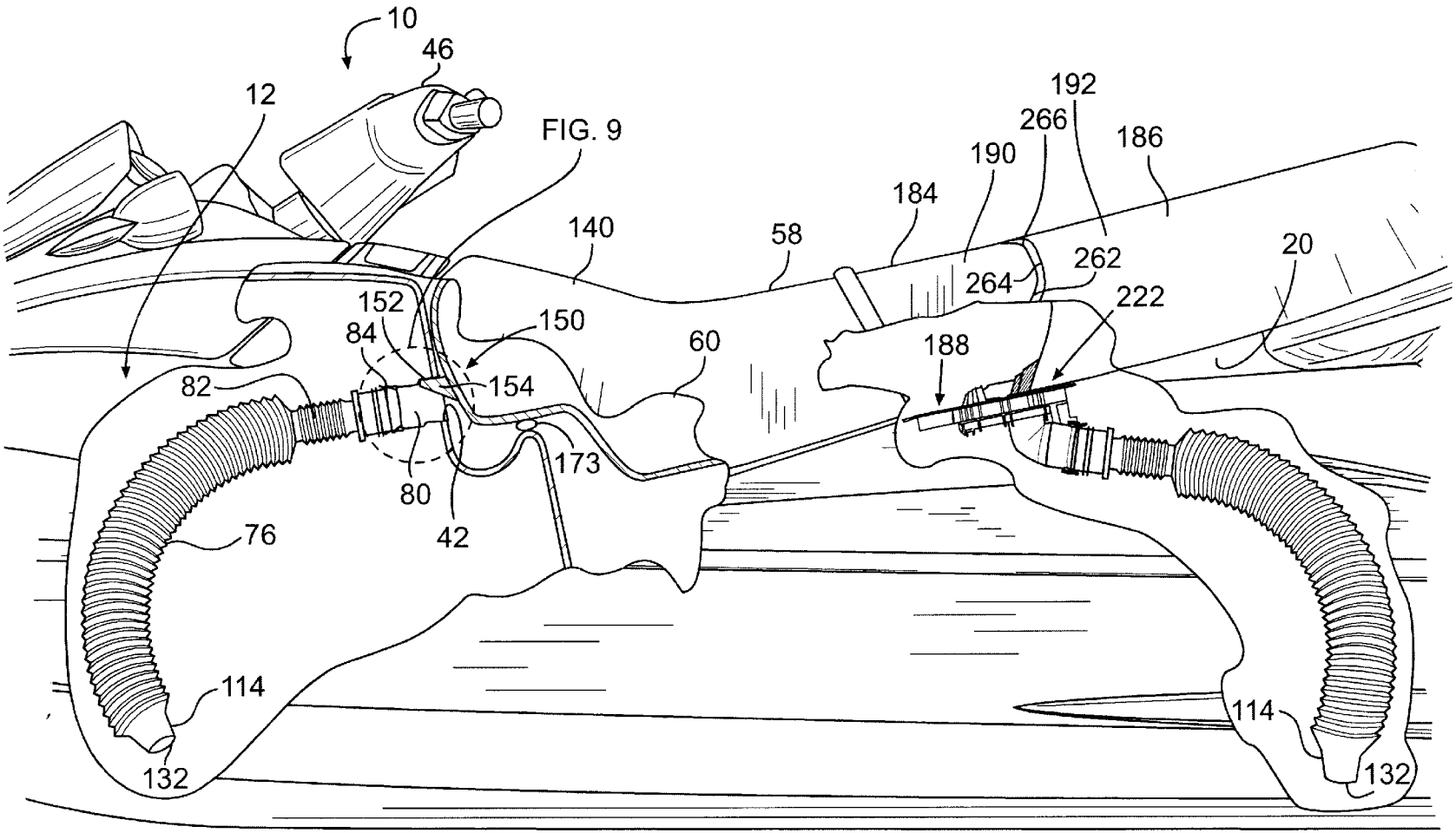
FIG. 8 is a side view of the personal watercraft shown in FIG. 7 with a cutout to detail hidden features.

As shown in FIG. 8, a tubular conduit 82 is connected to an inward portion 84 of the flanged connecting member 80. The tubular conduit 82 extends within the interior of the hull assembly 12 and allows air to flow therethrough to enter/exit the interior of the hull assembly 12.

Figure 9:
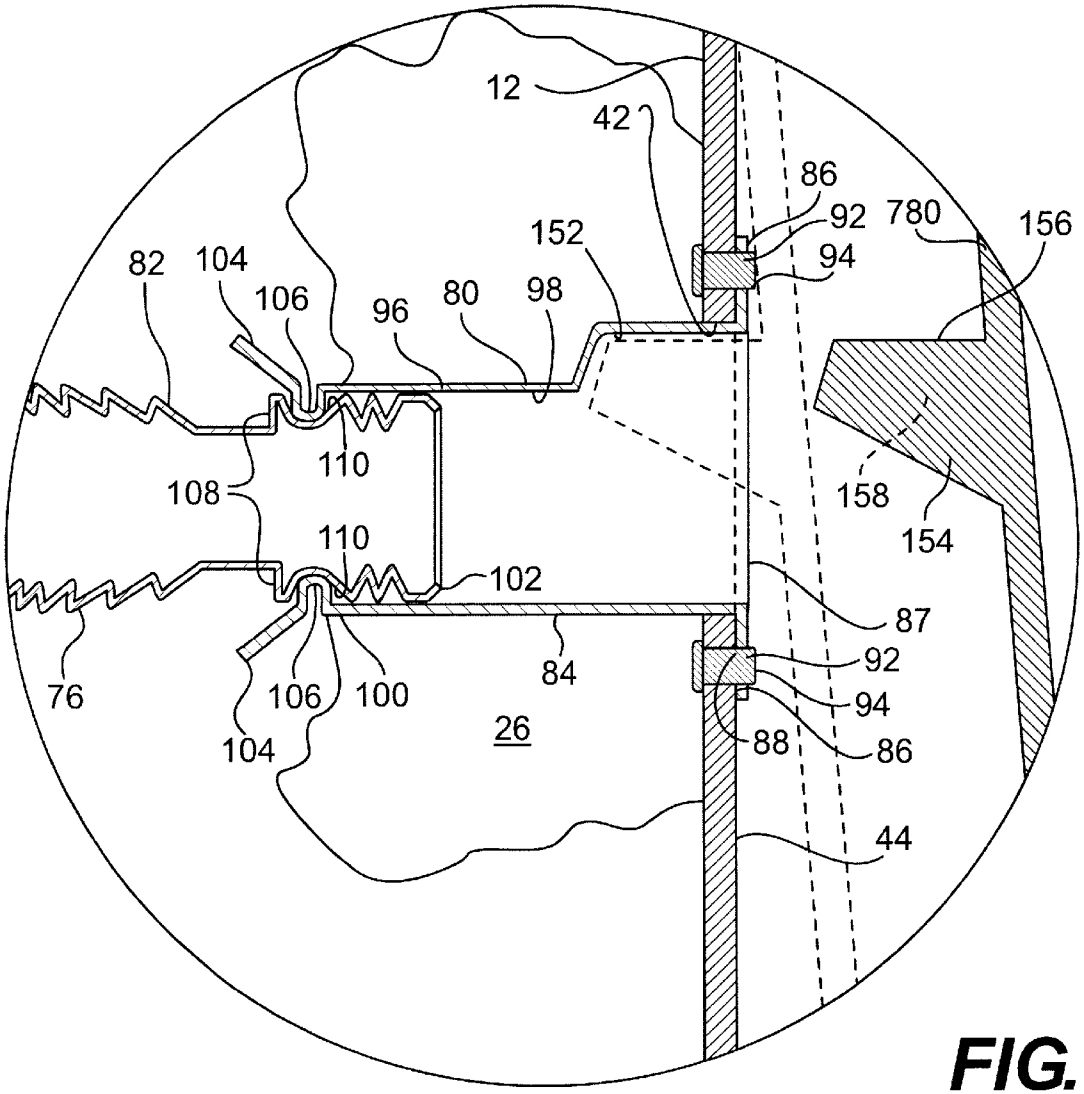
FIG. 9 is a detailed view of the forward ventilation subsystem shown in FIG. 7.

As shown in FIG. 9, the flanged connecting member 80 includes a radially outwardly extending flange structure 86 on an outward end portion 87 thereof. The flange structure 86 has a inwardly facing surface 88, which abuts the wall 44 of the hull assembly 12 adjacent a periphery of the ventilation opening 42. The flange structure 86 includes fastening openings 92, shown in FIG. 7, which may receive mechanical fasteners 94, such as bolts, rivets, or screws, to secure the flanged connecting member 80 to the hull assembly 12.

The flanged connecting member 80 also includes an inwardly extending portion 96, which extends from the flange structure 86, through the ventilation opening 42 to a position inward of the hull assembly 12. The inwardly extending portion 96 defines an opening 98 that is communicated to the atmosphere and allows air to flow therethrough. It is noted that the opening 98 may, alternatively, be formed from a plurality of openings within the inwardly extending portion 96. As shown in FIG. 7, the opening 98 may have an oval configuration. It is, of course, possible for the opening 98 to have any configuration that allows a substantial volume of air (relative to the size thereof) to flow therethrough.

As further shown in FIG. 9, the inwardly extending portion 96 includes a connecting portion 100 on the inward end portion 84. As shown, the connecting portion 100 may receive the tubular conduit 82 therein. More specifically, an end portion 102 of the tubular conduit 82 may be received within the connecting portion 100 such that an exterior surface of the end portion 102 of the tubular conduit 82 is engaged with an interior surface of the connecting portion 100. In this manner, the tubular conduit 82 is securely retained relative to the flanged connecting member 80 and air leakage between these two components (such as between the exterior surface of the tubular conduit 82 and the interior surface of the flanged connecting member 80) is minimized. It is also contemplated that the flanged connecting member 80 and tubular conduit 82 may be configured such that the end portion 102 of the tubular conduit 82 is received over the connecting portion 100 of the flanged connecting member 80. In this manner, an interior surface of the end portion 102 is engaged with an exterior surface of the connecting portion 100.

As further shown in FIG. 9, the connecting portion 100 may include a pair of resilient retaining elements 104 that extend generally inwardly therefrom. It is contemplated that the resilient retaining elements 104 may be integrally formed with the flanged connecting member 80, such as by integrally molding (as with a polymer material) or integrally shaping (as with a metallic material) the flanged connecting member 80 and the resilient retaining elements 104. It is also contemplated that the retaining elements may be formed of polymer or metallic material and joined to the flanged connecting member 80, such as with mechanical fasteners or adhesive.

As shown in FIG. 9, the end portion 102 of the tubular conduit 82 is slidably received within the connecting portion 100. The resilient retaining elements 104 include generally inwardly extending projections 106, which engage a retaining structure 108 of the end portion 102 of the tubular conduit 82. As shown, the retaining structure 108 may be a circumferential outwardly extending flange formed integrally with the tubular conduit 82. As shown, the resilient retaining elements 104 engage generally inwardly facing surface 110 of the retaining structure 108 to retain the tubular conduit 82 in position relative to the flanged connecting member 80. As such, the tubular conduit 82 is securely retained in position. It is also contemplated that the retaining structure 108 may be in the form of attachable elements (not shown) with which the retaining elements 104 engage. In this case, the attachable elements may be secured to the exterior of the end portion 102 of the tubular conduit 82 with, for example, mechanical fasteners or adhesive.

Referring to FIG. 8, the tubular conduit 82 may be provided by an air duct 76, as mentioned above and described below in more detail. As shown in FIG. 8, the tubular conduit 82 is connected to the flanged connecting member 80 and extends generally arcuately therefrom such that an opposite end portion 114 is disposed proximate a bottom interior surface of the hull assembly 12. The tubular conduit 82 is shown as being curved generally downwardly and may be further curved toward one of the starboard and port sides of the hull assembly 12. Although the configuration of the curve and direction of extension of the tubular conduit 82 may, of course, be altered, it is preferable that the end portion 114 be disposed proximate the bottom interior surface of the hull assembly 12 to ensure adequate air circulation within the interior of the hull assembly 12.

Figure 11:
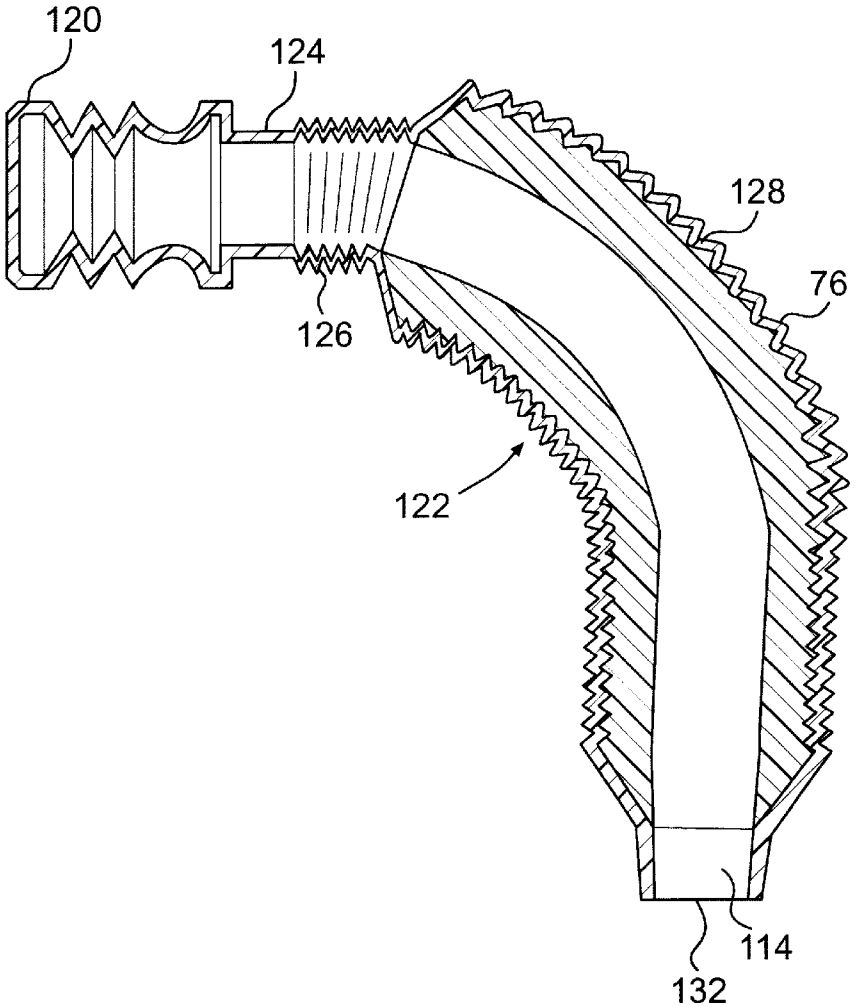
FIG. 11 is a cross-sectional view of a tubular duct.

Each of the embodiments of the forward ventilation subsystem 40 discussed above may utilize at least one duct 76 (note that the tubular conduit 82 may be provided by a duct 76). As shown in FIG. 11, each of the ducts 76 may include a connecting portion 120, which may connect to the associated branch of the branched portion of tubular conduit 74, or to the flanged connecting member 80, as described above. The duct 76 includes a cylindrical body portion 122. A neck segment 124 of the body portion 122 is connected to the connecting portion 120 and has a corrugated construction, indicated at 126, along at least a portion thereof. It is noted that the corrugated construction may add a degree of flexibility to the neck segment 124. An expanded segment 128 of the body portion 122 extends from the neck segment 124. The expanded segment 128 may have a corrugated configuration, as shown in FIG. 11, or may have another configuration, for example, a simple, cylindrical configuration. The expanded segment 128 is lined with a foam sound attenuating material to reduce noise of air flowing rapidly therethrough, such as produced when the engine is operating at a relatively high level, which is commonly referred to as intake roar and also to reduce the escape of noise through the duct 76 from the engine compartment 26, such as produced by the operation of the engine itself.

The body portion 122 may also include the end portion 114, which is preferably shaped to conform to the bottom interior surface of the hull assembly 12. The orientation of the duct 76 and the configuration of the end portion 114 may be manipulated such that a peripheral edge 132 of the end portion 114 is spaced relatively close to the bottom of the hull assembly 12 and is positioned relatively close to a lower most point of the hull assembly 12.

An exemplary method of forming the ducts 76 is described below. The duct 76 is molded, preferably from blow molding a resilient polymer material, to form the connecting and body portions 102, 122 including the neck and expanded segments 124, 128. It is noted that the corrugated constructions of the neck segment 124 and expanded segment 128 (if applicable) are formed in the molding process. A cylindrical core is then inserted within the body portion 122 to extend at least through the expanded segment 128. The cylindrical core preferably has an external configuration (e.g., size and sectional geometry) generally equivalent to an inner configuration of the neck segment 124, although deviations in the size and shape of the core are, of course, possible. A foam material is. then injected between an interior surface of the expanded segment 128 and an outer surface of the core. The core may then be removed from the body portion 122 such that the expanded segment 128 includes a lining of the foam material formed therein. The lining defines a central opening within the expanded segment 128, preferably roughly the size and geometry of the inner periphery of the neck segment 124 such that air may flow through the duct 76 relatively unrestricted.

It is noted that subsequent to the formation of the foam lining, the expanded segment 128 may be relatively resistant to bending deflection due to the rigidity of the molded foam lining. As such, in order to form the duct 76 into a configuration suitable for installation in the watercraft 10, the core may be formed with a curve or arc so that at least the expanded portion 128 maybe formed with a similar configuration. However, to facilitate removal of the core, it may be preferable that the curve or arc of the core be one of a single radius configuration.

Figure 10:
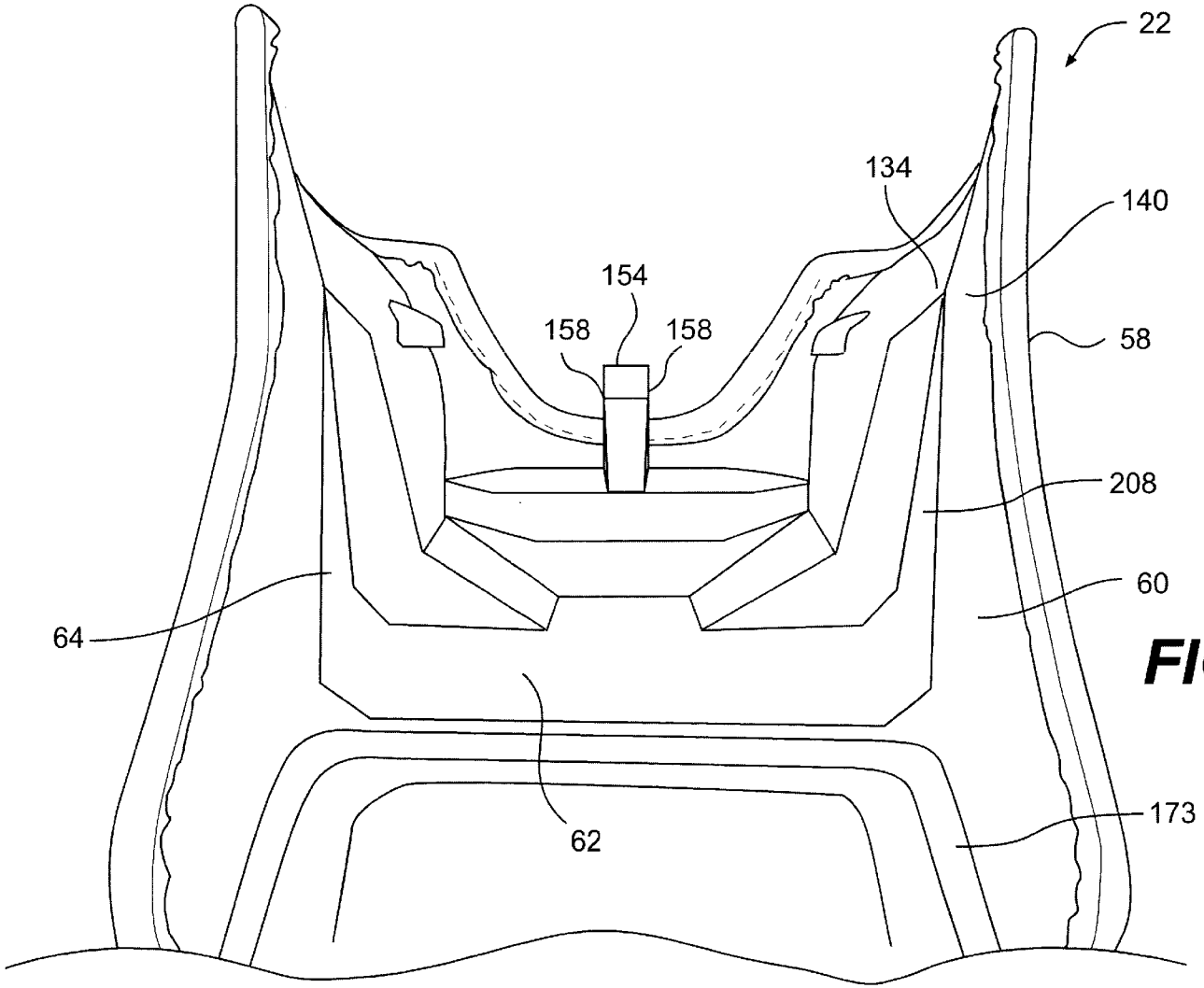
FIG. 10 is a bottom view of the forward portion of the seat with an alternate retaining member extending therefrom.

Shown in FIGS. 5 and 10, interior surface 60 of the seat 22 is provided by a seat substrate 134 that has a saddle-like configuration. Exterior surface 58 is provided by a cushioning layer, preferably in the form of foam material, covering the seat substrate 134 to increase rider comfort. The seat 22 may be retained relative to the hull assembly 12 by a forward seat retaining system 136.

Shown in FIG. 4, the forward seat retaining system 136 includes a retaining member 138 extending forwardly from a forward end portion 140 of the seat 22. When seat 22 is mounted to hull assembly 12, retaining member 138 extends from the forward end portion 140 to a position within ventilation opening 42. An upper surface 142 of retaining member 138 engages an upper edge 144 of ventilation opening 42. The engagement between upper surface 142 and upper edge 144 serves to vertically and laterally retain forward end portion 140 in a secured position on hull assembly 12. It is preferable that retaining member 138 be integrally molded with the seat substrate 134. This configuration is advantageous since the retaining member 138 is thereby integral with seat 22 and does not require additional componentry. However, it is contemplated that retaining member 138 may be a separate element that is fixedly fastened to seat substrate 134 by, for example, adhesive or mechanical fasteners, such as screws, bolts, or rivets.

The seat 22 may be retained relative to the hull assembly 12 by another exemplary embodiment of a forward seat retaining system, shown at 150 in FIG. 8. Shown in further detail in FIG. 9, the flanged connecting member 80 includes a retainment recess 152, which extends generally inwardly from the outward end portion 87 and is open to the opening 98. It is contemplated that the retainment recess 152 may be integrally formed with the flanged connecting member 80.

Referring back to FIG. 8, the seat 22 may include a forwardly extending retaining member 154. The retaining member 154 may be formed integrally with the seat substrate 134. It is also contemplated that the retaining member 154 may be formed separately from the seat substrate 134 and then secured thereto, such as with mechanical fasteners or adhesive. As shown in FIGS. 9 and 10, the retaining member 154 may be generally triangular in configuration with vertical and lateral retaining surfaces 156, 158, respectively, provided thereon.

Shown in FIG. 7, the retainment recess 152 provides vertical and lateral engagement surfaces 160, 162, which engage the vertical and lateral retaining surfaces 156, 158, respectively, when the retaining member 154 is positioned within the retainment recess 152. As discussed above, the flanged connecting member 80 is securely attached to the hull assembly 12 via the mechanical fasteners 94. Therefore, when the retaining member 154 is positioned within the retainment recess 152, such as shown in phantom in FIG. 9, movement of the forward end portion 140 of the seat 22 is restrained both vertically and laterally relative to the hull assembly 12. More specifically, the engagements between the lateral retaining surfaces 158 and the lateral engagement surfaces 162 serve to securely laterally retain the forward end portion 140 of the seat 22. The engagement between the vertical retainment surface 156 and the vertical engagement surface 160 serves to securely retain the forward end portion 140 of the seat 22 in a vertical direction. Therefore, movement of the seat 22 away from the hull assembly 12 is prevented.

As shown in FIG. 6, seat 22 is mounted in straddling relation to the pedestal portion 20. This configuration provides additional lateral retainment to seat 22. Furthermore, the saddle-like configuration of seat 22 provides additional cushioning to legs of a rider situated thereon.

Figure 12:
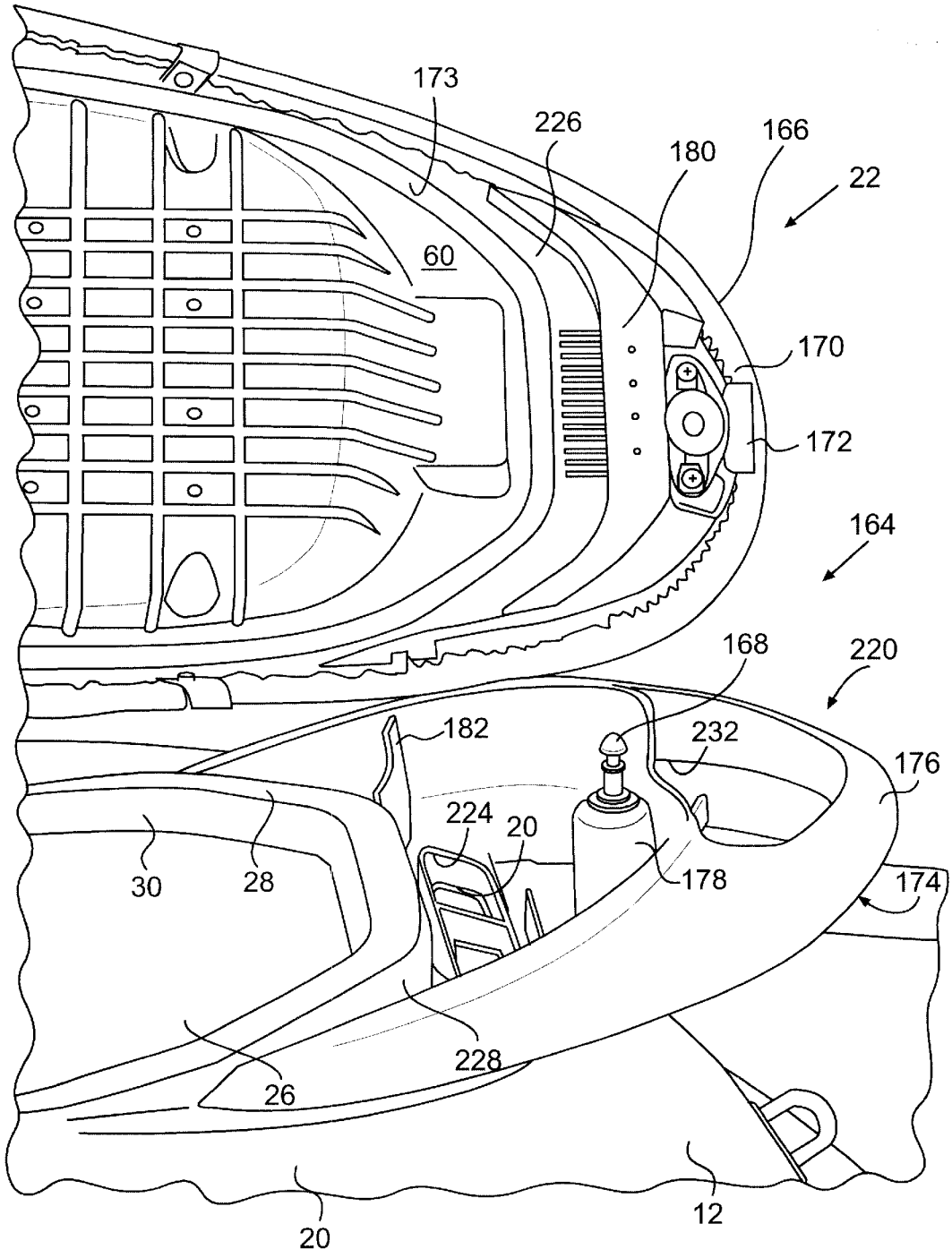
FIG. 12 is a perspective view of a rear portion of the pedestal portion with a bottom view of the aft portion of the seat.

FIG. 12 shows a contemplated embodiment of an aft seat retaining system 164, which utilizes an interlocking relationship between a first interlocking member, provided by hull assembly 12, and a second interlocking member, provided by seat 22 to retain an aft end portion 166 of seat 22. In the illustrated embodiment, the first interlocking member is in the form of a fixed bolt member 168, shown in FIGS. 12 and 13, carried on the hull assembly 12 and the second interlocking member is in the form of a movable latch member, shown at 170 in FIG. 12. The latch member 170 captures the bolt member 168 therein in latched relation and moves to a released position to release the bolt member 168 for removal of the seat 22. A manual release member 172 is accessible to the user and movable in a releasable manner to move latch member 170 to its released position.

Alternatively, the first interlocking member may be a movable latch member 170 and the second interlocking member may be a fixed bolt member 168. Regardless, any suitable interlocking arrangement for retaining the seat 22 in its operative position may be used.

Figure 14:
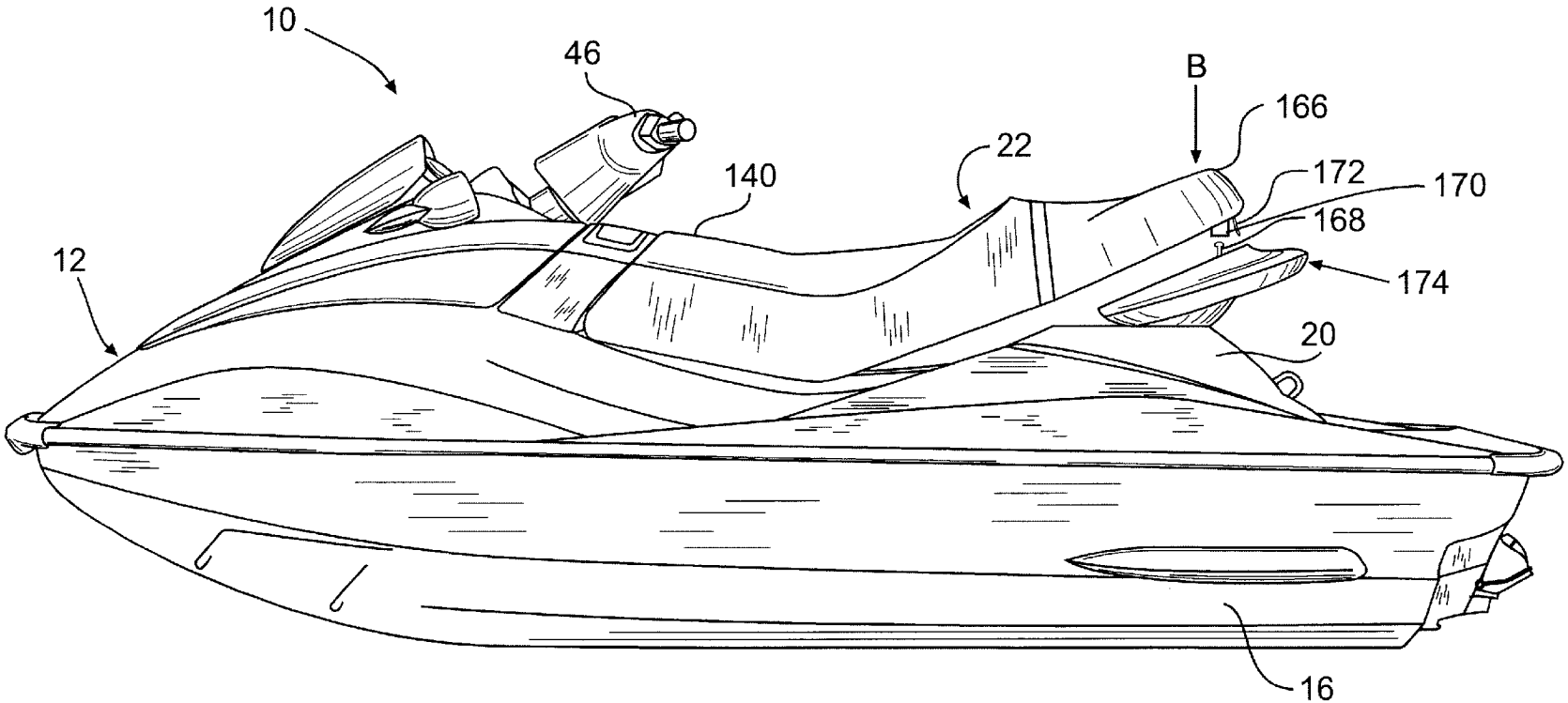
FIG. 14 is a side view of the personal watercraft shown with the seat positioned prior to attachment to the hull assembly.

FIG. 14 shows seat 22 in a position just prior to engagement between latch member 170 and fixed bolt member 168. To secure the seat 22 to the hull assembly 12 the forward end portion 140 of the seat 22 is first secured with either of the forward seat retaining systems 136, 150. It is noted that either of the forward seat retaining systems 136, 150 described above may be utilized along with the corresponding embodiment of forward ventilation subsystem 40. Then a downwardly directed force (as generally shown with arrow B in FIG. 14) is applied to the aft end portion 166 of the seat 22 to engage the latch member 170 with the bolt member 168. During this movement, the latch member 170 moves to its latched position to capture the bolt member 168 in latched relation, thus releasably locking the seat 22 until actuation of the release member 172. To detach the seat 22 from the hull assembly 12, the release member 172 is pivoted in a releasing manner to move the latch member 170 to release the fixed bolt member 116. The aft end portion 166 of seat 22 is then lifted upwardly to disengage the latch member 170 from the fixed bolt member 168. The seat 22 is then moved rearwardly to disengage the forward seat retaining system 136, 150.

A pliable gasket 173 (shown in FIG. 4) is attached to the interior surface 60 and serves to seal against the peripheral edge portion 28 of the pedestal portion 20 to thereby prevent water from entering the engine accessing opening 30.

As shown in FIG. 12, a seat retaining member 174 is fixedly mounted to an aft end of pedestal portion 20. Shown in greater detail in FIG. 13, the seat retaining member 174 includes a handle portion 176 on a rearward end thereof. The handle portion 176 is often referred to as a grab handle. Bolt member 168 is securely attached to an upstanding portion 178 of seat retaining member 174.

Referring back to FIG. 12, the interior surface 60 of seat 22 has a downwardly facing support surface 180. The seat retaining member 174 provides a plurality of upstanding support members 182 (shown in FIGS. 12 and 13), which extend upwardly inside an open interior of the seat retaining member 174. The support surface 180 engages upwardly facing surfaces of the support members 182 to thereby vertically support the aft end portion 166 of seat 22. It is noted that it may be preferable for the majority of vertical support for seat 22 to be provided by the peripheral edge portion 28 to maintain an adequate seal around engine compartment 26 and to provide a more desirable weight distribution on pedestal portion 20.

Figure 15:
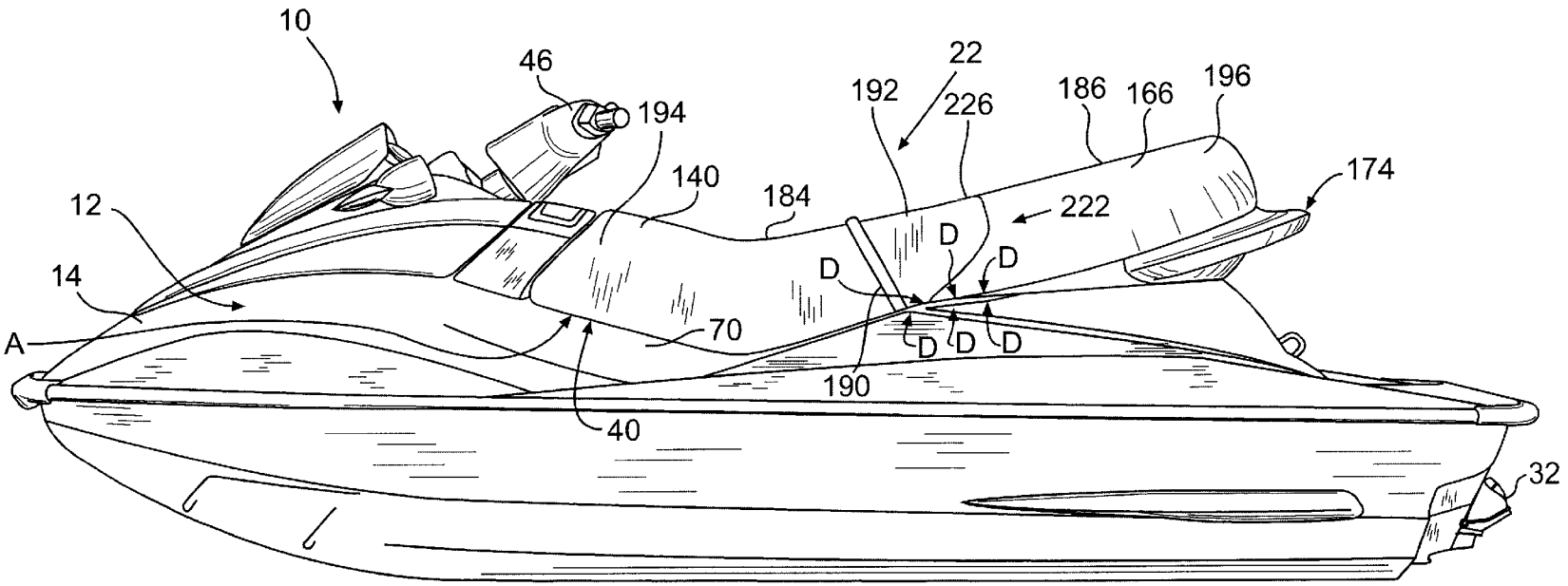
FIG. 15 is a side view of the watercraft showing a multiple-piece seat.
Figure 16:
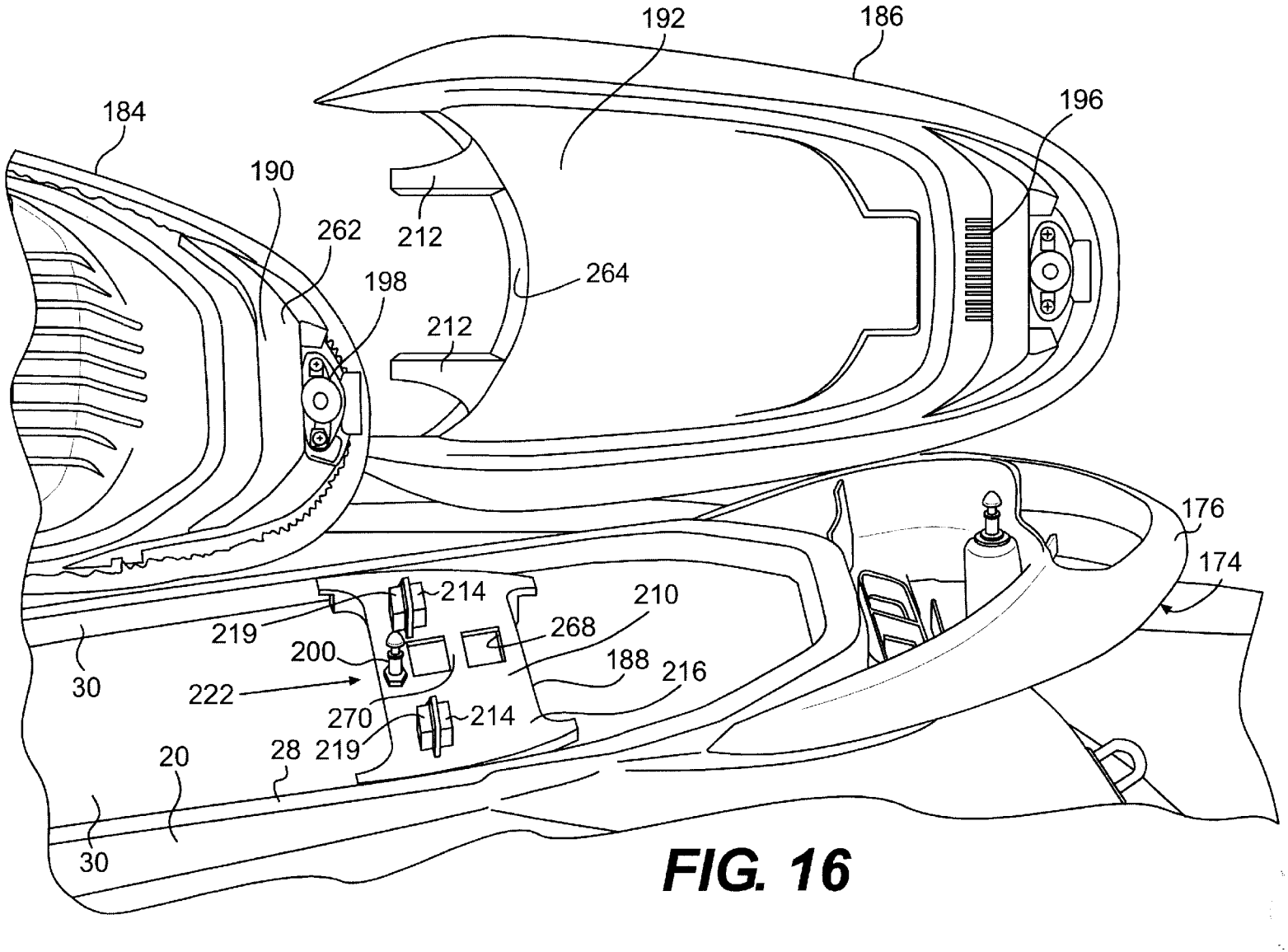
FIG. 16 is a perspective view of the rear portion of the pedestal portion showing a bottom view of the aft seating unit and forward seating unit.

It is contemplated that the seat 22 may have a single-piece configuration, such as shown in FIG. 14 and described above. It is also contemplated that the seat 22 may have a multiple-piece configuration including seating units, such as shown in FIG. 15. In the case of the multiple-piece seat configuration including forward and aft seating units 184, 186, a bridge assembly 188 is mounted to the hull assembly 12, as shown in FIG. 16. An aft end portion 190 of the forward seating unit 184 is detachably securable to the bridge assembly 188 and a forward end portion 192 of the aft seating unit 186 is securable to the bridge assembly 188. A forward end portion 194 of the forward seating unit 184 is securable to the hull assembly 12 with either of the forward seat retaining systems 136, 150 described above, while an aft end portion 196 of the aft seating unit 186 is securable to the hull assembly 12 with the aft seat retaining system 164, described above.

As shown in FIG. 16, the bridge assembly 188 is mounted to the peripheral edge portion 28. The aft end portion 190 of the forward seating unit 184 is releasably securable to the bridge assembly 188, similarly as with the aft seat retaining system 164. Preferably, the aft end portion 190 includes a first interlocking member, which may include a movable latch member 198, while the bridge assembly 188 includes a second interlocking member, which may include a fixed bolt member 200. As with the aft seat retaining system 164, the latch member 198 captures the bolt member 200 therein to secure the seating unit 184 and may be manually moved to a released position to remove the seating unit 184. The forward end portion 194 of the forward seating unit 184 may be secured to the hull assembly 12 with either of the forward seat retaining systems 136, 150 described above.

As shown in FIG. 16, the bridge assembly 188 includes a bridge supporting structure 210 extending laterally across the engine accessing opening 30 within the pedestal portion 20. The bridge supporting structure 210 is secured to the pedestal portion 20 at opposite lateral side portions thereof. Preferably, the bridge supporting structure 210 is secured to the pedestal portion 20 with a series of mechanical fasteners, such as bolts, screws, or rivets.

Figure 17:
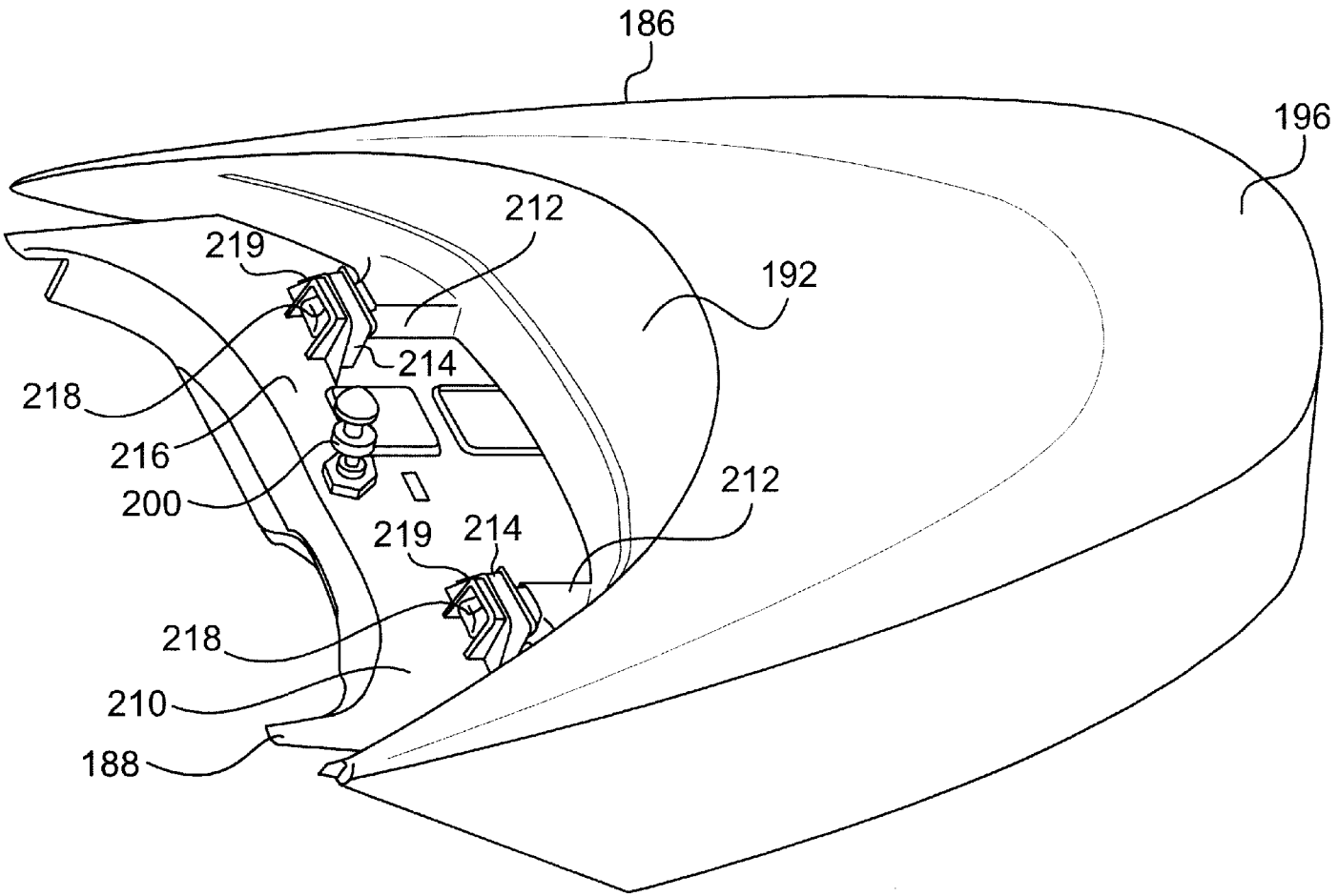
FIG. 17 is a perspective view of the aft seating unit attached to the bridge supporting structure.

As shown further in FIG. 16, a forward end portion 192 of the aft seating unit 186 includes a pair of laterally spaced, forward extending protrusions 212. Additionally, a pair of spaced capture members 214 extend from an upper surface 216 of the bridge supporting structure 210. As shown in FIG. 17, the capture members 214 are configured to accept and allow respective protrusions 212 to slidably engage therein. Specifically, each capture member 214 forms a longitudinally extending opening 218 (see FIG. 17) therein. The openings 218 are defined by respective generally inverted U-shaped retaining structures 219 and the upper surface 216.

The aft end portion 196 of the aft seating unit 186 is securable similarly as with the aft seat retaining system 164, described above with respect to the aft end portion 166 of the seat 22 (as shown in FIG. 12). As such, a detailed description is not given with respect to the aft end portion 196 of the aft seating unit 186.

Figure 16A:
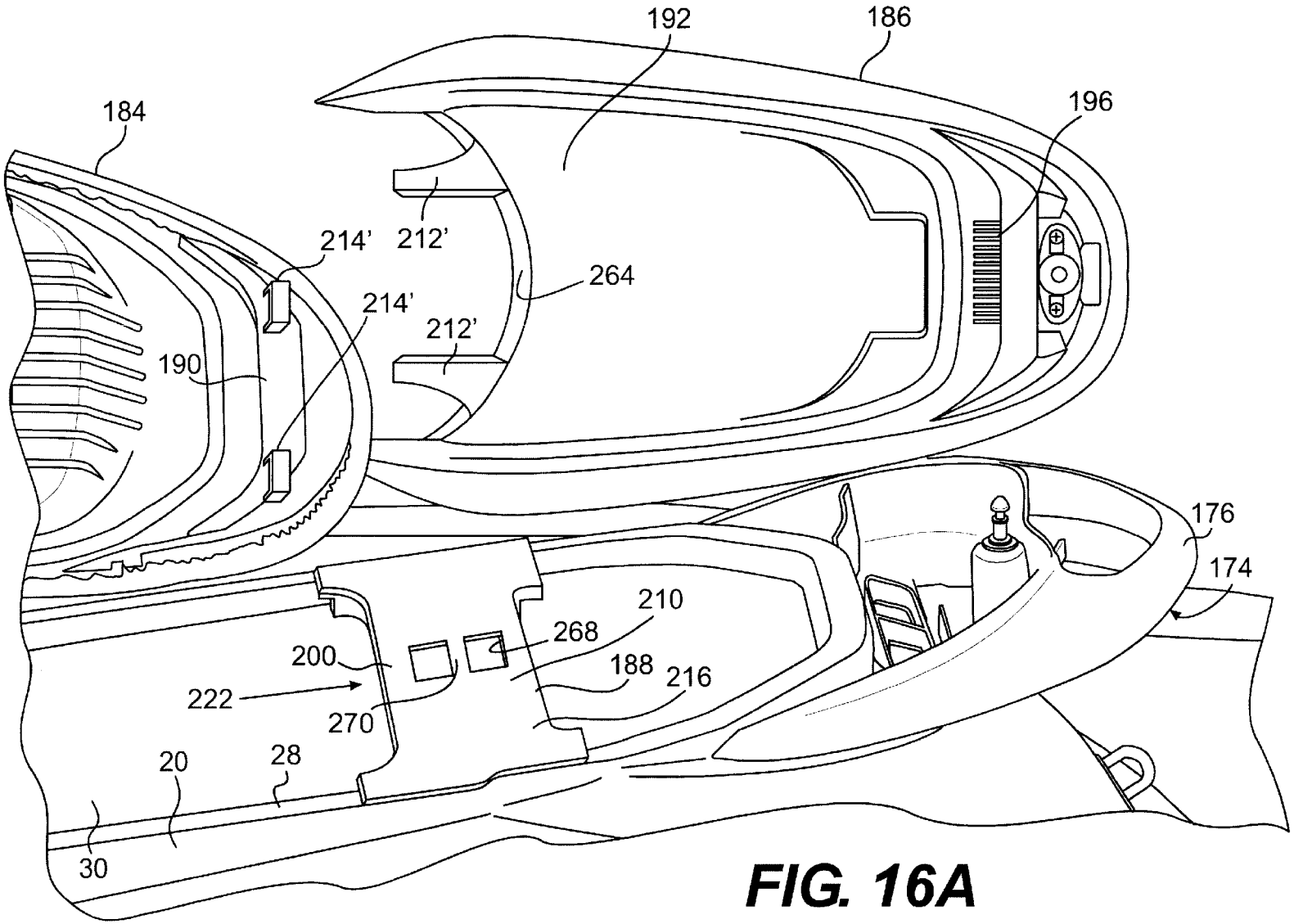
FIG. 16A is a perspective view of the rear portion of the pedestal showing a bottom view of an alternate aft seating unit and forward seating unit.

FIG. 16A shows an alternative method of connecting the forward and aft seating units 184, 186 to one another. As shown, the forward end portion 192 of the aft seating unit 186 includes a pair of protrusions 212', which may be similar to the protrusions 212 described above. Additionally, the aft end portion 190 of the forward seating unit 184 includes a pair of capture members 214', which may be similar to the capture members 214 described above. It is also contemplated, however, that the capture members may be in the form of openings within the aft end portion 190. In any case, the capture members 214' are configured to receive therein respective protrusions 212' to thereby secure the forward end portion 192 of the aft seating unit 186 to the aft end portion 190 of the forward seating unit 184. For the arrangement shown in FIG. 16A, the bridge supporting structure 210 may not be equipped with capture members 214, as shown in FIG. 16. However, it is contemplated that the bridge supporting structure 210 may include the capture members 214 and the protrusions 212 may be configured so as to extend through the capture members 214 and engage with the capture members 214', or vice versa, in order to secure both the forward and aft seating units 184, 186 to the bridge supporting structure 210.

As described above, circulation of air within the interior of the hull assembly 12 is affected by both an intake and exhaust of air into/out of the interior of the hull assembly 12. It is contemplated that air may simultaneously enter and exit any given ventilation opening (such as ventilation opening 42 described above) to affect circulation within the hull assembly 12. However, to facilitate air circulation within the hull assembly 12, the ventilation system of the present invention includes one of a rear ventilation subsystem 220 and a bridge ventilation subsystem 222, along with the forward ventilation subsystem 40. It is noted that during high level engine operation both the forward ventilation subsystem 40 and the rear ventilation subsystem 220 (or the bridge ventilation subsystem 222 if applicable) may be primarily used as air intakes, due to the large magnitude air suction produced by the engine 24.

Shown in FIG. 12, the rear ventilation subsystem 220 includes a ventilation opening 224 within the seat retaining member 174 and the pedestal portion 20. The rear ventilation subsystem 220 includes a ventilation passage, indicated by arrows C in FIGS. 13 and 18, which are communicated with the ventilation opening 224. As shown in FIG. 12, a partial air pathway 226 provided on the interior surface 60 of the seat 22 cooperates with a partial air pathway 228 provided by the seat retaining member 174 and the pedestal portion 20 to provide the ventilation passage C. The partial air pathway 226 is provided by a concave recess formed in the seat substrate 134. The partial air pathway 228 is provided by exterior surfaces of the seat retaining member 174 and pedestal portion 20.

Figure 18:
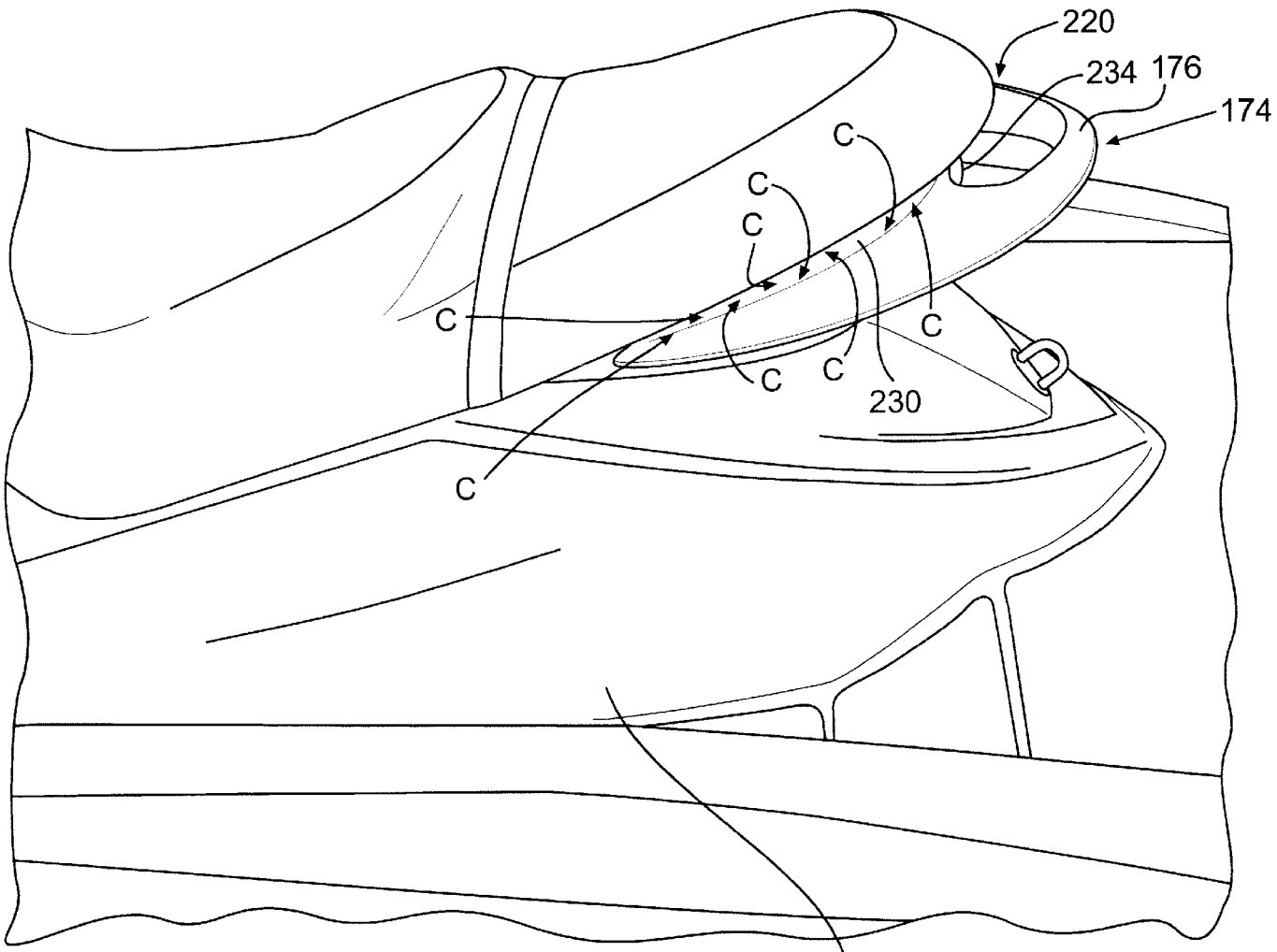
FIG. 18 is a perspective view of the aft end portion of the watercraft.

A spaced relationship between the interior surface 60 of the seat 22 and the seat retaining member 174 forms a gap 230, shown in FIG. 18, between the seat 22 and the seat retaining member 174, which allows air to flow between the ventilation opening 224 and the atmosphere. It is noted that the gap 230 may be of any width that allows sufficient air to pass therethrough, however it may be preferable for the gap to be relatively narrow in width, to minimize the chance for water to flow through the gap 230 and through the ventilation opening 224.

Referring back to FIG. 12, the seat retaining member 174 also includes a partial release member access opening 232, which cooperates with the interior surface 60 to form a release member access opening 234 (see FIG. 18). The release member access opening 234 allows an operator to easily reach and manipulate the release member 172.

Figure 13:
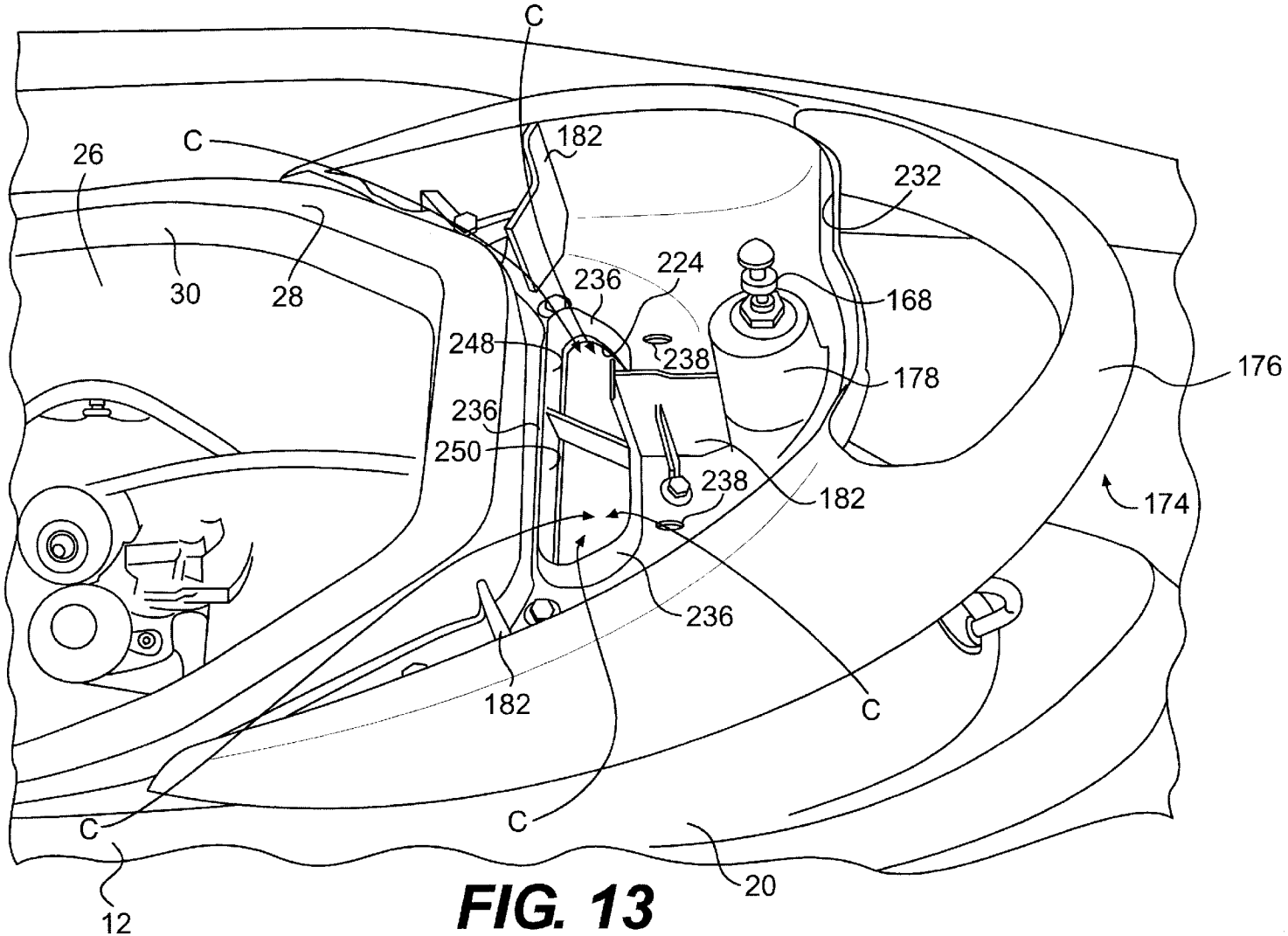
FIG. 13 is a detailed perspective view of the seat retaining member.

Shown in FIG. 13, the interior surface of the seat retaining member 174 is generally bowl-like in configuration. This bowl-like configuration causes water entering pathway C through gap 230 to flow downwardly towards a lowest point of the retaining member interior. A plurality of upstanding wall elements 236 extend upwardly from the bottom interior surface of the seat retaining member 174 in surrounding relation with respect to the ventilation opening 224, effectively elevating the ventilation opening 224 to inhibit water from entering the ventilation opening 224. The seat retaining member 174 may be constructed with one or more openings 238 extending therethrough which allow the water caught in the seat retaining member 174 to drain therethrough.

Figure 19:
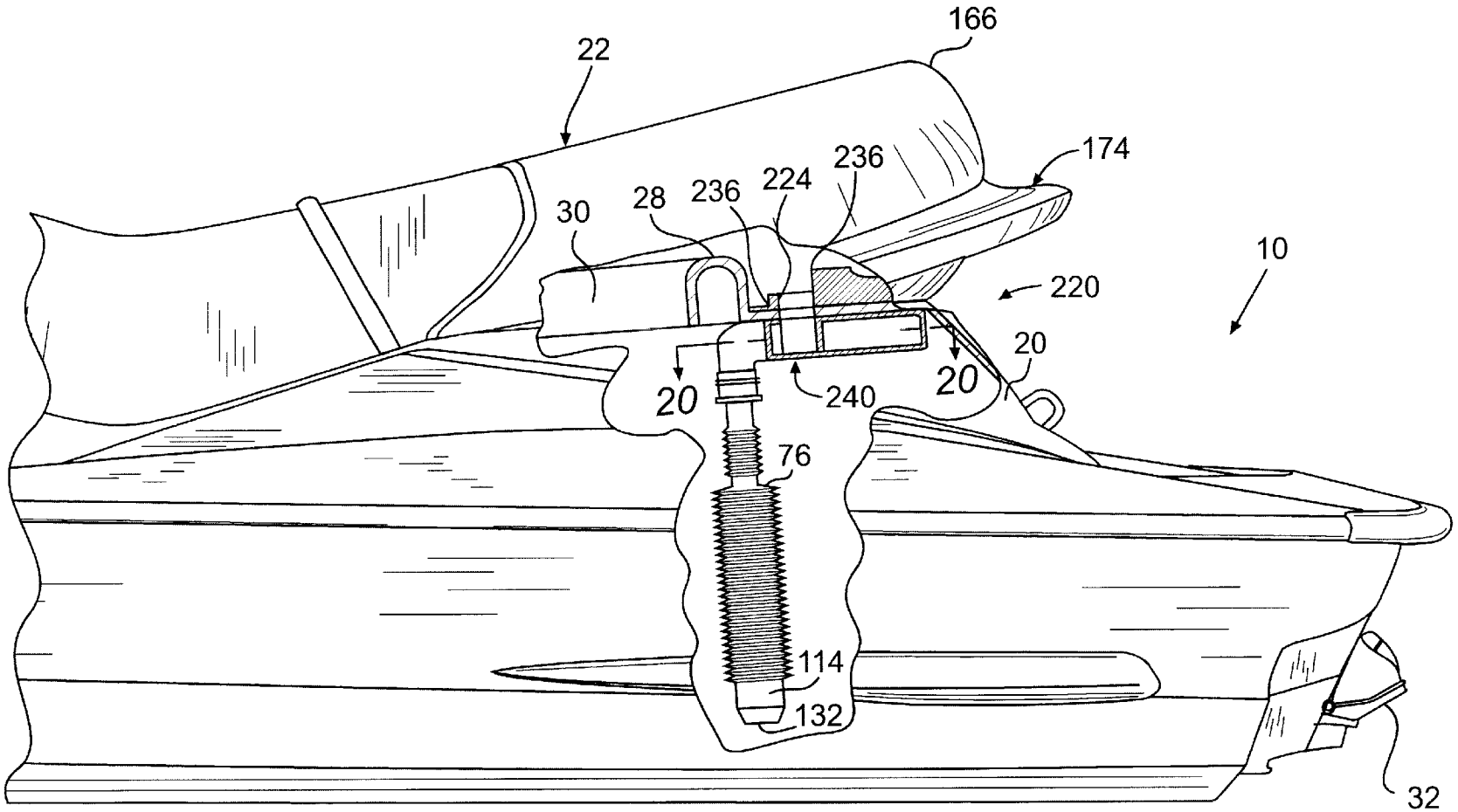
FIG. 19 is a cut out view of the rear ventilation subsystem.

Shown in FIG. 19, a rear ventilation body 240 is mounted within the interior of the hull assembly 12 by, for example, threaded fasteners extending vertically through the seat retaining member 174 and the pedestal portion 20 and secured to the rear ventilation body 240 to thereby fixedly attach both the ventilation body 240 and the seat retaining member 174 to the pedestal portion 20. The rear ventilation body 240 is communicated to the ventilation opening 224, which is located on the longitudinal centerline of the hull assembly 12.

Figure 20:
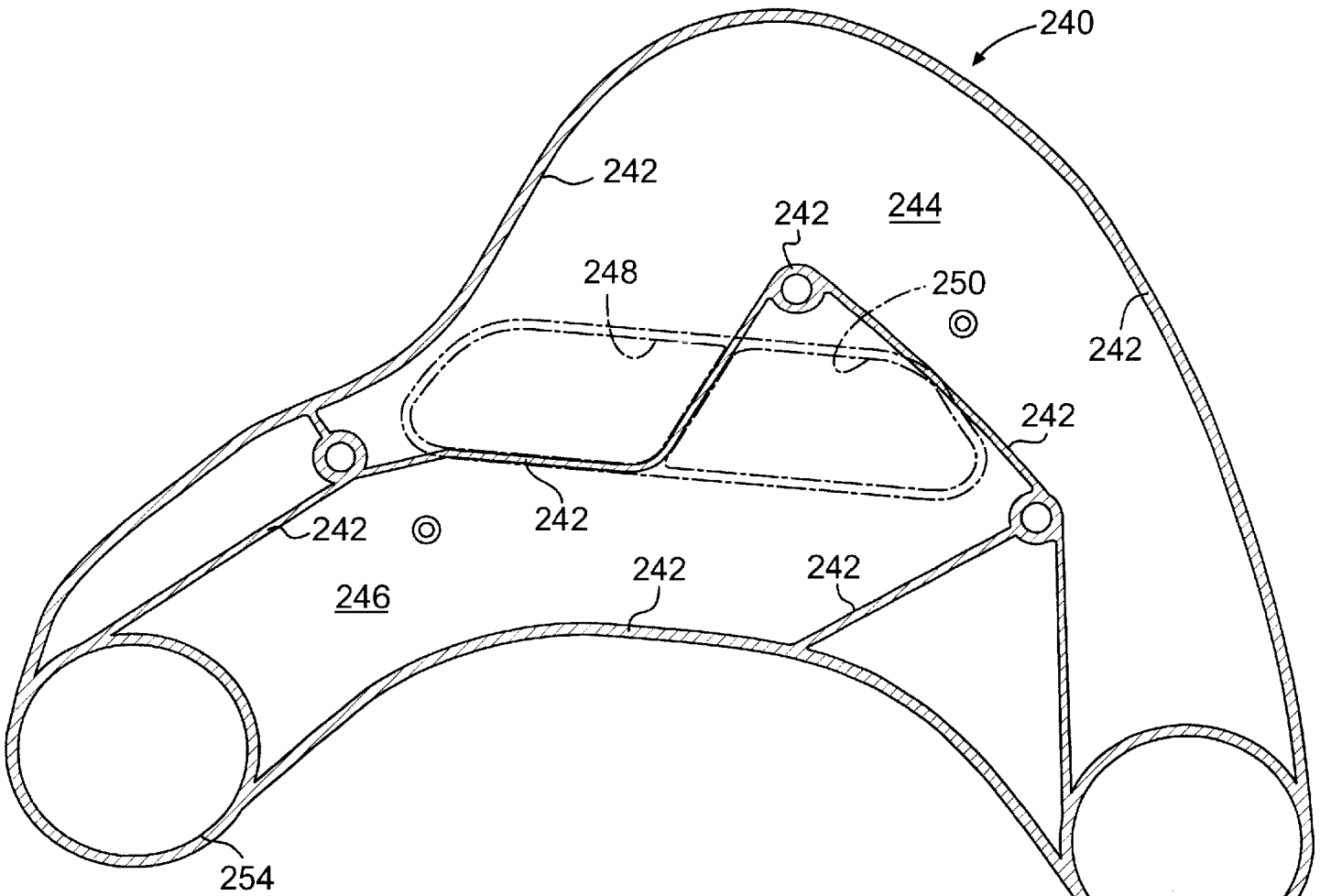
FIG. 20 is a sectional view of the rear ventilation body.

Shown in FIG. 20, the rear ventilation body 240 comprises a plurality of wall members 242 that define first and second ventilation passages 244, 246, respectively. Shown in FIG. 13, the upstanding wall elements 236 are configured such that they divide the ventilation opening 224 into adjacent starboard and port ventilation openings 248, 250. Shown in FIG. 20, first ventilation passage 244 is open at one end thereof to the starboard side ventilation opening 248, while the second ventilation passage 246 is open at one end thereof to the port side ventilation opening 250. Opposite ends of the first and second ventilation openings 244, 246 define port and starboard side ports 252, 254, respectively. As can be appreciated from the Figures, the ventilation passage 244 extends generally laterally from the starboard side ventilation opening 248 to the port side port 252 and the ventilation passage 246 extends generally laterally from the port ventilation opening 250 to the starboard side port 254. The port and starboard side ports 252, 254 are spaced laterally from one another and laterally outwardly from the centerline of the hull assembly 12, whereas the ventilation openings 248, 250 are positioned immediately adjacent one another and generally at the centerline of the hull assembly 12.

By providing the ventilation passages 244, 246 with a cross-over configuration as shown, water is inhibited from entering the hull assembly 12 during rollover conditions. For example, if the watercraft 10 were tilted to the starboard side so that the water collected within the retaining member 174 and flowed over the lip of the starboard ventilation opening 248, the ventilation passage 244 would be angled upwardly as a result of the roll angle of the watercraft 10, thus causing gravity to inhibit water from flowing up the passage 244 and into the hull assembly 12.

Referring to FIG. 19, another duct 76 is connected to each of the port and starboard side ports 252, 254 and depend downwardly therefrom. As described herein above, the ducts 76 direct the air in a downwardly facing direction, such that water present within the air flowing therein is directed toward the bottom interior surface of the hull assembly 100.

The air exiting ducts 76 is then taken in by the internal combustion engine 24 to be mixed with fuel and combusted for power generation. An air box or other air/water separating device (not shown) may be connected to the engine air intake (not shown) to separate any excess water from the air. As described previously, the ducts 76 include sound attenuating foam to reduce the volume of engine roar.

Alternatively, when a multiple-piece seat is used (such as one including forward and aft seating units as described above), the bridge ventilation subsystem 222 may be utilized. As shown in FIG. 8, the bridge assembly 188 is disposed on the pedestal portion 20 with the aft end portion 190 of the forward seating unit 184 and the forward end portion 192 of the aft seating unit 186 disposed above and connected to the bridge assembly 188.

The aft end portion 190 of the forward seating unit 184 provides a partial air pathway 262 on a lower edge thereof that cooperates with a partial air pathway 264 provided by a lower edge of the forward end portion 192 of the aft seating unit 186 to form an air passage indicated by arrows D in FIG. 15. The air passage D is communicated to the atmosphere at one end via a gap 266 formed between the seating units 184, 186 and the peripheral edge portion 28 of the pedestal portion 20 and to the bridge assembly 188 at an opposite end of the air passage D. More specifically, as shown in FIG. 16, the bridge supporting structure 210 has a vertically extending ventilation opening 268 that communicates with the air passage D. As shown, the ventilation opening 268 may be provided with a stiffening structure 270 extending across a width thereof to maintain the rigidity of the bridge supporting structure 210.

Figure 21:
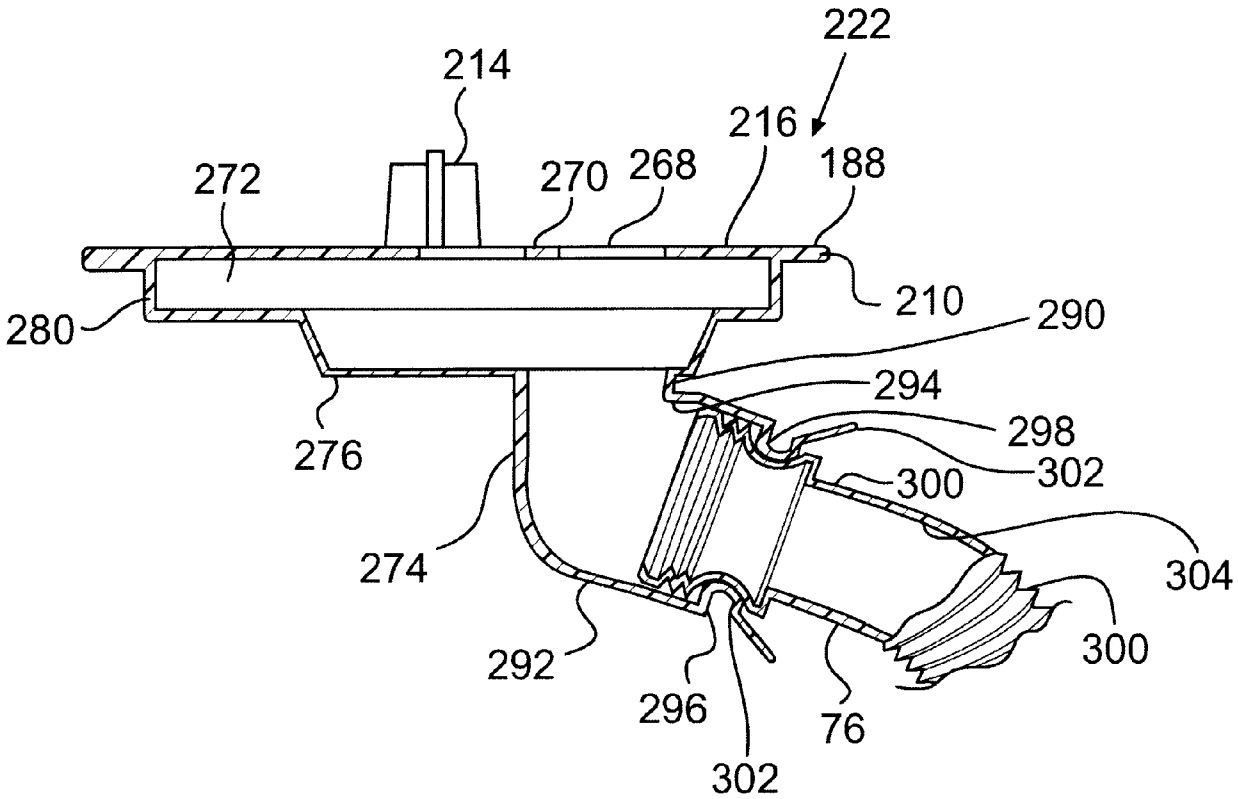
FIG. 21 is a cross-sectional view of the bridge ventilation subsystem.

As shown in FIG. 21, the bridge supporting structure 210 forms an air chamber 272 therein that is communicated with the air passage D via the ventilation opening 268. The bridge assembly 188 also includes an elbow structure 274 extending generally downwardly from the bridge supporting structure 210.

As shown in FIG. 21, the bridge supporting structure 210 includes a mounting member 276, which mounts to the pedestal portion 20 of the hull assembly 12, as described above and the elbow structure 274. The elbow structure 274 may be integrally formed with the mounting member 276, such as by integrally molding the elbow structure 274 with a polymer material or integrally shaping the elbow structure 274 with metallic material. It is also contemplated that the elbow structure 274 may be formed separately and then joined to the mounting member 276 with adhesive or mechanical fasteners. As shown, the elbow structure 274 may include a first tubular portion 290, which extends downwardly from the mounting member 276 generally normal thereto, and a second tubular portion 292, which extends from the first tubular portion 290 at an angle relative thereto. Each of the first and second tubular portions 290, 292 has a central opening 298 extending therethrough. The elbow structure 274 has a connecting portion 296 connected to a lowermost end of the second tubular portion 292.

The connecting portion 296 includes a central opening 298 that is communicated to the central opening 294 so as to provide an air passage therethrough with the first and second tubular portions 290, 292 communicated with the air chamber 272. A tubular conduit 300, preferably in the form of a duct 76, described above, is removably connected to the connecting portion 296 and extends therefrom generally towards the bottom of the hull assembly 12. The tubular conduit 300 is secured to the connecting portion 296 in similar fashion as the tubular conduit 82 is connected to the flanged connecting member 80, described above. A pair of resilient retaining elements 302 serve to secure the tubular conduit 300 relative to the connecting portion 296. The tubular conduit 300 includes a central opening 304 in communication with the central opening 298 of the connecting portion 296. As such, the interior of the hull assembly 12 is communicated with the atmosphere via the tubular conduit 300, the elbow structure 274, the air chamber 272, and the air passage D.

It is noted that at slow speeds or at idle, the engine 24 pulls in a relatively small amount of air. In this case, a single ventilation system, any of the forward ventilation subsystems 40, the rear ventilation subsystem 220 and the bridge ventilation subsystem 222 may provide sufficient air flow to the engine 24, while the other of the ventilation systems serve to exhaust the interior of the hull assembly 12. However, at higher engine speeds, the engine 24 pulls in a relatively greater amount of air and as such, both ventilation subsystems (one of embodiments of the forward ventilation subsystems 40 and one of the rear ventilation and bridge ventilation subsystems 220, 222) may act primarily as air intakes for the engine 24.

While the principles of the present invention have been made clear in the illustrative embodiments set forth above, it will be apparent to those skilled in the art that various modifications may be made to the structure, arrangement, proportion, elements, materials, and components used in the practice of the invention. This invention includes all modifications encompassed within the spirit and scope of the following claims.

What is claimed:

1. A personal watercraft for traveling along the surface of a body of water, said personal watercraft comprising:

a hull assembly having a rearwardly facing ventilation opening that allows ambient air to flow into the interior of said hull assembly, said hull assembly having an exterior surface;

an internal combustion engine mounted within said hull assembly, said engine being constructed and arranged to generate power by combusting a mixture of fuel and air; and a seat having an exterior seating surface configured to accommodate at least one rider seated thereon and an interior surface configured to engage with the exterior surface of said hull assembly;

said ventilation opening being formed through said hull assembly in a position forward of said seat, said seat being mounted on said hull assembly such that (a) said seat covers said ventilation opening of said hull assembly to obstruct water from flowing therein; and (b) said seat interior surface and said hull assembly exterior surface are positioned adjacent one another in cooperating relation to form one or more air pathways between said seat and said hull assembly, each of said one or more air pathways extending between said ventilation opening and the atmosphere to enable air to flow between the atmosphere and the ventilation opening between said seat and said hull assembly.

2. A personal watercraft according to claim 1, wherein said exterior surface of said hull has one or more portions thereof defining one or more partial air pathways and wherein said interior surface of said seat has one or more portions thereof defining one or more partial air pathways, said seat interior surface and said hull assembly exterior surface being positioned adjacent one another such that said partial air pathways of said seat interior surface and said hull exterior surface cooperate to form said one or more air pathways between said seat and said hull assembly.

3. A personal watercraft as in claim 2, further comprising a tubular conduit, said tubular conduit communicated to said ventilation opening and extending forwardly therefrom.

4. A personal watercraft as in claim 3, wherein said tubular conduit extends substantially horizontally from said ventilation opening.

5. A personal watercraft as in claim 3, wherein said tubular conduit extends horizontally from said ventilation opening.

6. A personal watercraft as in claim 3, wherein said ventilation opening is disposed along a centerline of said hull assembly.

7. A personal watercraft as in claim 6, wherein said one or more air pathways includes a port side air pathway and a starboard side air pathway.

8. A personal watercraft as in claim 2, wherein said seat is releasably mounted to said hull assembly, said seat having a retaining member engagable within said ventilation opening with a cooperating interlocking relationship.

9. A personal watercraft as in claim 8, wherein said seat includes a first interlocking member spaced from said retaining member and being engagable with a second interlocking member provided on said hull assembly.

10. A personal watercraft as in claim 8, wherein said ventilation opening includes a notched portion and said retaining member includes a notch engaging portion, said notch engaging portion being engagable with said notched portion.

11. A personal watercraft as in claim 8, wherein at least one of said interlocking members is movable to a released position to permit removal of said seat.

12. A personal watercraft as in claim 3, wherein said tubular conduit extends substantially horizontally from said ventilation opening, first slightly upwardly and then slightly downwardly.

13. A personal watercraft for traveling along the surface of a body of water, said personal watercraft comprising:

a hull assembly having a ventilation opening that allows ambient air to flow into the interior of said hull assembly;

an internal combustion engine mounted within said hull assembly, said engine being constructed and arranged to generate power by combusting a mixture of fuel and air; and a seat having an exterior seating surface configured to accommodate at least one rider seated thereon, said seat having a retaining member and being mounted on said hull assembly with said seat being retained on said hull assembly by said retaining member being received within said ventilation opening.

14. A personal watercraft as in claim 13, wherein said seat includes a first interlocking member spaced from said retaining member and being engagable with a second interlocking member provided on said hull assembly in a cooperating interlocking relationship.

15. A personal watercraft as in claim 14, wherein one of said first and second interlocking members is manually movable out of said cooperating interlocking relationship to, permit removal of said seat.

16. A personal watercraft as in claim 15, wherein said first interlocking member is a fixed bolt member carried on said hull assembly and wherein said second interlocking member is a movable latch member carried on said seat, said movable latch member being movable between (a) a latched position wherein said latch member engages said bolt member to affect said cooperating interlocked relationship and (b) said released position wherein said latch member is disengaged from said bolt member, said seat further comprising a release member constructed and arranged such that movement thereof moves said latch member from said latched position to said released position.

17. A personal watercraft as in claim 16, wherein said retaining member is positioned at a forward end portion of said seat and said latch member is positioned at a rearward portion of said seat.

18. A personal watercraft as in claim 17, wherein said ventilation opening is positioned along a centerline of said hull assembly.

19. A personal watercraft as in claim 18, wherein said ventilation opening faces rearwardly.

20. A personal watercraft for travelling along the surface of a body of water, said personal watercraft comprising:

a hull assembly having a ventilation opening formed in an aft portion thereof;

an internal combustion engine mounted within said hull assembly, said engine being constructed and arranged to generate power by combusting a mixture of fuel and air; and a ventilation body having port and starboard inlet ports positioned immediately adjacent one another at the longitudinal centerline of said hull assembly and a port and starboard outlet ports spaced apart from one another and laterally from said longitudinal centerline of said hull assembly, said ventilation body defining a first fluid path extending laterally from said port inlet port to said starboard outlet port and a second fluid path extending laterally from said starboard inlet port to said port outlet port;

said ventilation body being connected to said ventilation opening such that air can flow into said inlet ports of said ventilation body at said ventilation opening, through said first and second fluid paths, and out said outlet ports into said hull assembly.

21. A personal watercraft as in claim 20, wherein said ventilation opening and said ventilation body are positioned under a seat mounted on said hull assembly.

22. A personal watercraft as in claim 21, wherein said ventilation opening and said ventilation body are position ed under a rearward portion of said seat.

23. A personal watercraft as in claim 20, wherein a pair of downwardly extending ducts are connected to said starboard and port outlet ports.

24. A personal watercraft as in claim 20, further comprising a grab handle structure mounted to said aft portion of said hull assembly.

25. A personal watercraft as in claim 24, wherein said grab handle structure is positioned between an aft portion of said seat and said aft portion of said hull assembly.

26. A personal watercraft as in claim 25, wherein said grab handle structure includes openings extending therethrough corresponding to and communicating with said port and starboard inlet ports of said ventilation body.

27. A personal watercraft for traveling along the surface of a body of water, said personal watercraft comprising:

a hull assembly having a deck portion;

a seat removably mounted to said deck portion and being elongated in a longitudinal direction of said hull assembly, said seat including a forward seating unit and an aft seating unit;

said aft seating having a forward portion thereof including connecting structure extending generally forwardly therefrom;

said forward seating unit having a rearward portion thereof including a connecting structure receptacle capable of receiving said connecting structure to thereby secure said aft seating unit relative to said forward seating unit.

* * * * *